US009207578B2

(12) United States Patent
Koshimori et al.

(10) Patent No.: US 9,207,578 B2
(45) Date of Patent: Dec. 8, 2015

(54) POWDER CONTAINER AND IMAGE FORMING APPARATUS

(71) Applicant: FUJI XEROX CO., LTD., Tokyo (JP)

(72) Inventors: Kazunori Koshimori, Kanagawa (JP); Shota Makita, Kanagawa (JP); Koutarou Yoshihara, Kanagawa (JP); Yuta Hoshino, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/298,313

(22) Filed: Jun. 6, 2014

(65) Prior Publication Data

US 2014/0286677 A1 Sep. 25, 2014

Related U.S. Application Data

(62) Division of application No. 13/727,384, filed on Dec. 26, 2012, now Pat. No. 8,958,725.

(30) Foreign Application Priority Data

Feb. 21, 2012 (JP) ..... 2012-035556
Feb. 21, 2012 (JP) ..... 2012-035558
Feb. 21, 2012 (JP) ..... 2012-035560

(51) Int. Cl.
*G03G 15/08* (2006.01)
*G03G 21/16* (2006.01)
*G03G 21/18* (2006.01)

(52) U.S. Cl.
CPC ..... *G03G 15/0889* (2013.01); *G03G 15/0841* (2013.01); *G03G 15/0865* (2013.01);

(Continued)

(58) Field of Classification Search
CPC ..... G03G 15/0886; G03G 15/0865; G03G 15/0867; G03G 15/0877; G03G 2215/085
See application file for complete search history.

(56) References Cited

U.S. PATENT DOCUMENTS 4,785,319 A 11/1988 Fujino et al.
5,047,803 A 9/1991 Kanoto (Continued)

FOREIGN PATENT DOCUMENTS

EP 0 682 297 A2 11/1995
EP 0 794 472 A1 9/1997

(Continued)

OTHER PUBLICATIONS

Mar. 13, 2015 Office Action cited in U.S. Appl. No. 14/298,315.

(Continued)

*Primary Examiner* — G. M. Hyder
(74) *Attorney, Agent, or Firm* — Oliff PLC

(57) ABSTRACT

A powder container includes a body and a pair of walls that blocks one longitudinal end of the body and the other longitudinal end of the body. Powder is accommodated within the powder container which is mounted to an apparatus using the powder in a posture where a longitudinal direction of the body is a transverse direction of the apparatus. The powder container has an opening, through which the powder is supplied to the apparatus, formed in a lower position of the body in a posture where the powder container is mounted to the apparatus. The powder container includes a shutter and a shield. The shutter is, prior to mounting the powder container to the apparatus, in a closed location to block the opening and, when the powder container is mounted, is moved along an outer peripheral surface of the body to an opened location to open the opening.

7 Claims, 35 Drawing Sheets

(52) U.S. Cl.
CPC ..... *G03G15/0867* (2013.01); *G03G 15/0882* (2013.01); *G03G 15/0886* (2013.01); *G03G 21/1633* (2013.01); *G03G 21/1647* (2013.01); *G03G 21/1846* (2013.01); *G03G 21/1676* (2013.01); *G03G 2221/1654* (2013.01)

(56) References Cited

U.S. PATENT DOCUMENTS

| | | | | |
|---|---|---|---|---|
| 5,247,316 | A | 9/1993 | Kamori et al. | |
| 5,260,750 | A * | 11/1993 | Ishida et al. | 399/262 |
| 5,331,382 | A | 7/1994 | Miura et al. | |
| 5,489,976 | A | 2/1996 | Ichikawa | |
| 5,506,665 | A * | 4/1996 | Ishida et al. | 399/119 |
| 5,870,652 | A * | 2/1999 | Kanamori et al. | 399/106 |
| 5,890,034 | A * | 3/1999 | Nakano et al. | 399/106 |
| 5,918,095 | A * | 6/1999 | Huang | 399/263 |
| 7,163,032 | B2 * | 1/2007 | Itabashi | 141/12 |
| 8,244,162 | B2 | 8/2012 | Takashima | |
| 2001/0046395 | A1 * | 11/2001 | Ashikari et al. | 399/262 |
| 2006/0285885 | A1 | 12/2006 | Lee | |
| 2007/0081834 | A1 | 4/2007 | Koyama et al. | |
| 2007/0092302 | A1 | 4/2007 | Koyama | |
| 2007/0140743 | A1 * | 6/2007 | Kamimura | 399/254 |
| 2007/0269225 | A1 * | 11/2007 | Sato | 399/12 |
| 2008/0019738 | A1 * | 1/2008 | Yoon et al. | 399/258 |
| 2008/0124105 | A1 | 5/2008 | Okamoto et al. | |
| 2009/0238608 | A1 | 9/2009 | Murase et al. | |
| 2009/0274491 | A1 * | 11/2009 | Sato | 399/281 |
| 2009/0297178 | A1 * | 12/2009 | Kakuta et al. | 399/27 |
| 2011/0008076 | A1 * | 1/2011 | Kuroyama | 399/263 |
| 2011/0020039 | A1 | 1/2011 | Mitsuishi et al. | |
| 2011/0026974 | A1 | 2/2011 | Kunihiro et al. | |
| 2012/0099887 | A1 | 4/2012 | Shokaku | |
| 2012/0114387 | A1 | 5/2012 | Horii et al. | |
| 2012/0114389 | A1 | 5/2012 | Tsumita | |
| 2013/0216273 | A1 | 8/2013 | Koshimori | |

FOREIGN PATENT DOCUMENTS

| | | |
|---|---|---|
| EP | 0 805 379 B1 | 8/1998 |
| JP | A-7-281519 | 10/1995 |
| JP | A-2003-280347 | 10/2003 |
| JP | A-2005-221831 | 8/2005 |
| JP | A-2008-90207 | 4/2008 |
| JP | A-2008-268593 | 11/2008 |
| JP | A-2009-80477 | 4/2009 |
| JP | A-2009-222807 | 10/2009 |
| JP | A-2009-229938 | 10/2009 |
| JP | A-2010-2493 | 1/2010 |
| JP | A-2011-33836 | 2/2011 |

OTHER PUBLICATIONS

Australian Office Action issued in Australian Patent Application No. 2013200139 on May 10, 2013.
Australian Search Report issued in Australian Patent Application No. 2013200139 dated Feb. 28, 2014.
U.S. Appl. No. 13/727,384, filed Dec. 26, 2012.
Jun. 20, 2014 Office Action issued in U.S. Appl. No. 13/727,384.

* cited by examiner

POWDER CONTAINER AND IMAGE FORMING APPARATUS

CROSS-REFERENCE TO RELATED APPLICATIONS

This is a Division of application Ser. No. 13/727,384 flied Dec. 26, 2012. This application is also based upon and claims priority under 35 USC 119 from Japanese Patent Application Nos. 2012-035558 (filed on Feb. 21, 2012), 2012-035560 (filed on Feb. 21, 2012) and 2012-035556 (filed on Feb. 21, 2012). The disclosure of the prior applications is hereby incorporated by reference herein in its entirety.

BACKGROUND

1. Technical Field

The present invention relates to a powder container and an image forming apparatus.

2. Related Art

A powder container for accommodating a powder is used in various fields. For example, a toner cartridge for accommodating toner which is powder developing agent is used in electrophotography type printers.

SUMMARY OF THE INVENTION

An object of the present invention is to provide a powder container configured to prevent the inner powder from leaking out as impact is applied to an end of a shutter member that closes an opening through which the inner powder is supplied, and an image forming apparatus provided with the powder container.

(1) According to an aspect of the invention, a powder container includes:

a body; and a pair of walls that blocks one longitudinal end of the body and the other longitudinal end of the body, powder being accommodated within the powder container and the powder container being mounted to an apparatus using the powder in a posture where a longitudinal direction of the body is a transverse direction of the apparatus, wherein the powder container has an opening, through which the powder within the powder container is supplied to the apparatus, formed in a lower position of the body in a posture where the powder container is mounted to the apparatus, and wherein the powder container further includes:

a shutter that is, prior to mounting the powder container to the apparatus, in a closed location to block the opening and, when the powder container is mounted to the apparatus, is moved along an outer peripheral surface of the body to an opened location to open the opening, and a shield that forms a part of the outer surface of the body which extends to a position which is adjacent to the end of the shutter at the closed location in the moving direction toward the closed location, and is higher than the end of the shutter in a radial direction of the body from a longitudinal center line of the body.

(2) The powder container of (1) further includes a circuit board that is disposed in a position which is above the outer peripheral surface of the body and is next to the shutter in the longitudinal direction of the body, and in the longitudinal direction, the shield extends to the position next to the shutter and to a location next to the circuit board.

(3) In the powder container of (1) or (2), a knob is installed on the outer peripheral surface of the body at a rear end portion in the direction of mounting the powder container to the apparatus in the posture where the powder container is mounted to the apparatus, the knob being adapted to be grasped when the powder container is mounted to or unmounted from the container.

(4) In the powder container of (3), the shield forms a flat plane that forms a part of the outer surface of the body below the knob in the posture where the powder container is mounted to the apparatus.

(5) In the powder container of any of (1) to (4), the shield extends to a position close to a bottom surface of an inner wall surface forming a space of the apparatus for receiving the powder container in the state where the powder container is mounted to the apparatus.

(6) The powder container of any of (1) to (5), the shield shields the outside of the apparatus and the circuit board in the direction of mounting the powder container to the apparatus in the state where the powder container is mounted to the apparatus.

(7) An image forming apparatus is mounted with the powder container according to any one of (1) to (6) to form an image using the powder accommodated within the powder container.

With the configuration of (1) and (7), the inner powder may be prevented from leaking out as the impact is applied to the end of the shutter member closing the opening through which the inner powder is supplied.

With the configuration of (2), the damage of the circuit board at a time of drop may also be prevented by the shield.

With the configuration of (3), the powder container may be mounted to the apparatus while the knob is being strongly grasped.

With the configuration of (4), it is easy to fabricate the body by molding of a resin, as compared to forming a curved shield.

With the configuration of (5), the user may be prevented from being contacted to the circuit board in a state where the powder container is mounted to the apparatus.

With the configuration of (6), the user may be prevented from being contacted to the circuit board in a state where the powder container is mounted to the apparatus.

Another object of the present invention is to provide a powder container having an agitation member which is improved in agitating performance is increased while being prevented from falling down at the time of assembling, and an image forming apparatus in which the powder container is mounted thereto.

(8) According to another aspect of the invention, a powder container includes:

a container body that includes a body and a wall portion that caps one longitudinal end of the body, powder is filled in the container body in a state where the other end of the body is opened;

an agitation member that agitates the powder accommodated within the container body, the agitation member being accommodated in the container body and receiving a driving force from outside to be rotated and to agitate the powder; and a cover that covers the other end of the body, wherein the agitation member further includes:

a shaft member installed in the longitudinal direction of the body, receiving the driving force from the outside to be rotated, and including:

a driving force receiving part formed at a wall side end of the shaft member to receive the driving force from the outside; and a supported part formed at a cover side end of the shaft member to be rotatably supported by the cover;

a flexible sheet type member that agitates the powder accommodated within the container body, the flexible sheet being supported by the shaft member and extending in the diameter direction toward the inner peripheral surface of the body; and a plurality of arm members that extend in a plurality of directions from the shaft member toward the inner peripheral surface of the body with respect to the rotation direction of the shaft member, respectively, which are different from the direction where the sheet type member extends toward the inner peripheral surface of the body with respect to the rotation direction of the shaft member, the plurality of arm members being rotated integrally with the shaft member, and the cover includes a supporting part that rotatably supports the supported part of the shaft member.

(9) In the powder container of (8), the plurality of arm members includes:

a plurality of first arm members installed on the shaft member closer to the wall portion than a center portion of the shaft member in a longitudinal direction of the shaft member and rotated integrally with the shaft member; and a plurality of second arm members installed on the shaft member closer to the cover than the center portion of the shaft member in the longitudinal direction of the shaft member and rotated integrally with the shaft member.

(10) In the powder container of (9), at least one arm member among the first arm members and the second arm members includes an inclined surface that generates a component force pressing the powder in a direction to the center portion when the shaft member rotates.

(11) In the powder container of any of (8) to (10), the powder container is mountable to an apparatus that receives and uses the powder accommodated within the powder container in a posture where the longitudinal direction is the transverse direction of the apparatus, and includes an opening below the shaft member in the posture where the powder container is mounted to the apparatus, the powder within the powder container being supplied to the apparatus through the opening, and at least one arm member among the first arm members and the second arm members passes through a location that faces the opening when the shaft member rotates.

(12) An image forming apparatus is mounted with a powder container according to any one of (8) to (11) to form an image using the powder accommodated within the powder container.

With the configurations of (8) and (12), the falling down of the shaft member may be prevented when the powder is accommodated, thereby improving the agitating performance of the accommodated powder as compared to a case where an arm member rotated integrally with the shaft member is not provided.

With the configuration of (9), either when the interior powder is cohered in the vicinity of the wall or when the interior powder is cohered to the cover side, the cohesion may be loosened, which is comparable to a case where only one of the first arm member and the second arm member is provided.

With the configuration of (10), the agitating performance of the accommodated powder may be improved as compared to a case where an inclined surface is not provided.

With the configuration of (11), the clogging of the powder in the opening may be prevented.

Another object of the present invention is to provide a powder container of which the manipulation of mounting to an apparatus is easy, and an image forming apparatus mounted with the powder container.

(13) According to another aspect of the invention, a powder container includes:

a body; and a pair of walls that blocks one longitudinal end of the body and the other longitudinal end of the body, powder being accommodated within the powder container and the powder container being mounted to an apparatus that uses the powder, wherein each of the pair of walls includes:

a first locking portion having a cantilever shape and configured to be prevented from being withdrawn from the apparatus such that the powder container is pulled out from the apparatus when the powder container is mounted to the apparatus; and a second locking portion configured to be prevented from being withdrawn such that the powder container is not withdrawn from the apparatus by being pressed by a movable member of the apparatus by the movement of the movable member of the apparatus after the powder container is prevented from being withdrawn by the first locking portion.

(14) In the powder container of (13), a first wall of the pair of walls that blocks the one end, constitutes a container body that receives the powder in a state where the other end is opened, together with the body, a second wall of the pair of walls that blocks the other end is a cover that blocks the other end after the powder is accommodated within the container body, the first locking portion provided in the first wall has the cantilever shape that extends along the outer wall surface of the first wall in a direction of crossing a longitudinal direction of the body, and the first locking portion provided in the second wall has the cantilever shape that protrudes in the longitudinal direction of the body from the outer wall surface of the second wall.

(15) In the powder container of (13) or (14), the powder container receives a repulsive force relatively stronger in the direction of pulling out the powder container from the apparatus at the vicinity of the first wall side than at the vicinity of the second wall side when the powder container is mounted to the apparatus, and the first locking portion provided in the first wall has the cantilever shape where the distance between the fixed end and the free-end of the cantilever shape is relatively longer than that in the first locking portion provided in the second wall.

(16) In the powder container of any of (13) to (15), the powder container receives a repulsive force stronger relatively in the direction of pulling out the powder container from the apparatus at the vicinity of the first wall side than at the vicinity of the second wall side when the powder container is mounted to the apparatus, and the first locking portion provided in the first wall is a locking portion that is prevented from being withdrawn by a locking force relatively stronger than that of the first locking portion provided in the second wall.

(17) In the powder container of (15) or (16), in the vicinity of the first wall of the body, there are provided an opening through which the powder within the powder container is supplied to the apparatus, and a shutter that is, prior to mounting the powder container to the apparatus, disposed in a closed location to block the opening, and is, in the state where the powder container is mounted, moved along the outer peripheral surface of the body to an opened location to open the opening, and in the state where the powder container is mounted to the apparatus, the shutter receives an action from the movable member of the apparatus to be moved to the opened location.

(18) An image forming apparatus is mounted with a powder container according to any one of (13) to (17) to form an image using the powder accommodated within the powder container.

With the configurations of (13) and (18, the manipulation to mount the powder container to the apparatus is ease as compared to a case where the first locking portion is not provided.

With the configuration of (14), the manufacturing of the powder container is easy as compared to a case where the configuration of the present invention is not provided.

With the configurations of (15) to (17), the balance of the left and right forces in the longitudinal direction of the powder container when manipulating is improved as compared to a case where the configuration of the present invention is not provided.

BRIEF DESCRIPTION OF THE DRAWINGS

Exemplary embodiments of the invention will be described in detail based on the following figures, wherein.

DETAILED DESCRIPTION

Hereinafter, exemplary embodiments of the present invention will be described.

(Entire Construction)

Figure 1:
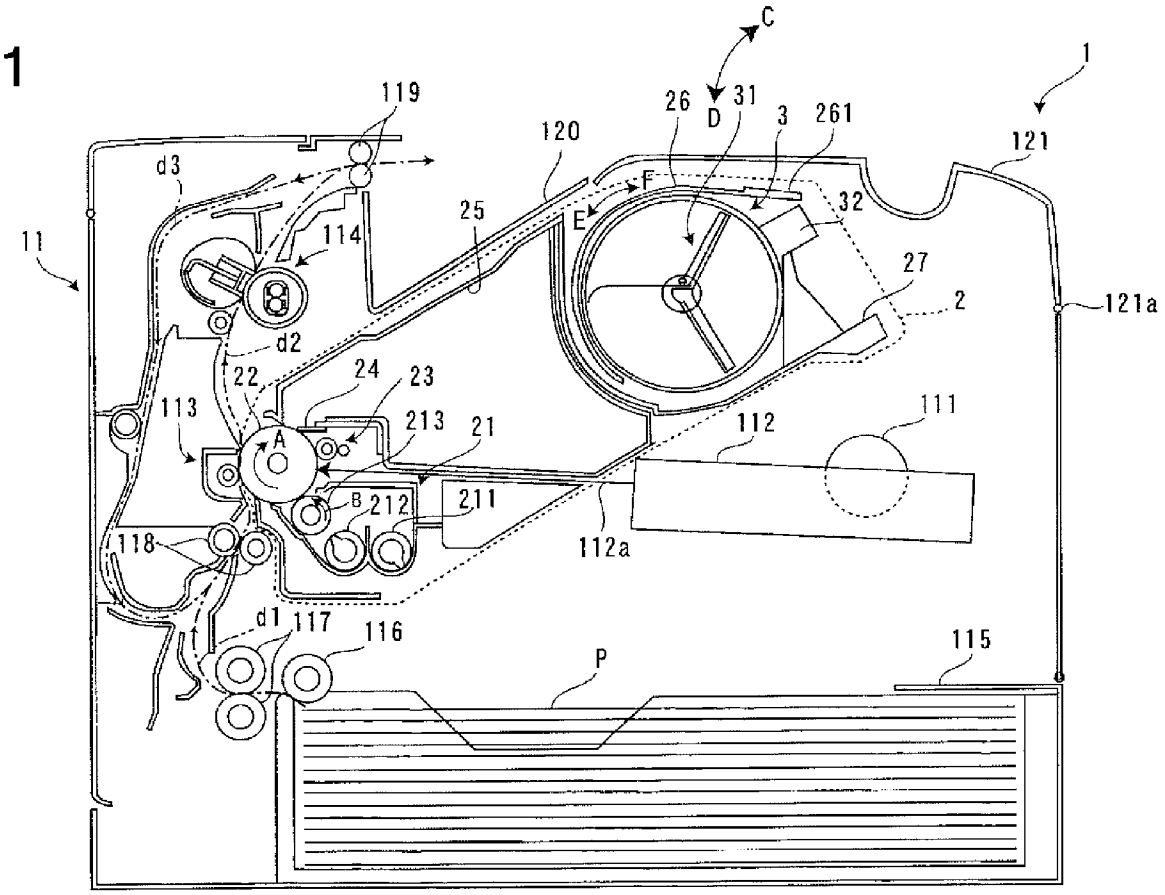
FIG. 1 is a schematic view of a printer to which a toner cartridge is mounted as an embodiment of a powder container according to the present invention.

FIG. 1 is a schematic view of a printer to which a toner cartridge is mounted as an embodiment of a powder container according to the present invention.

A printer 1 shown in FIG. 1 prints an image on a sheet of paper P by an electrophotography means, and a right side surface of FIG. 1 is taken as a front surface of the apparatus. The printer 1 is configured such that a process cartridge 2 is detachably mounted to a printer body 11 on a front side of the apparatus. Even when the process cartridge 2 remains mounted to the printer body 11, the toner cartridge 3 is detachably mounted to the process cartridge 2 on a front side of the apparatus.

Here, the toner cartridge 3 corresponds to an example of a powder container of the present invention, and a construction including the printer body 11 and the parts of the process cartridge 2 excluding the toner cartridge 3 corresponds to an example of the apparatus of the present invention.

A distributed toner is accommodated in the toner cartridge 3, and the toner in the toner cartridge 3 is agitated through rotation of an agitation member 31 in order to be prevented from cohering. A driving force is transferred to the agitation member 31 from the motor 111 installed in the printer body 11 through a gear (not shown). The toner in the toner cartridge 3 is supplied to the developing unit 21 installed in the process cartridge 2.

The process cartridge 2 includes a developing unit 21, a photosensitizer 22, a charging unit 23, and a cleaner 24, and a waste toner accommodating chamber 25 for accommodating waste toner scraped and collected on the photosensitizer 22 with the cleaner 24 is installed between the developing unit 21 or the photosensitizer 22 and the toner cartridge 3.

An exposure unit 112 for irradiating exposure light 112*a* toward the photosensitizer 22 and a transfer unit 113 disposed at a location opposite to the photosensitizer 22 are installed in the printer body 11.

Various operations as will be described are applied to the photosensitizer 22 while the photosensitizer 22 rotates in a direction of arrow A.

The charging unit 23 charges a surface of the photosensitizer 22 to a predetermined electric potential.

The exposure unit 112 irradiates the exposure light 112*a* according to an image signal to the charged surface of the photosensitizer 22 to form an electrostatic latent image on the surface of the photosensitizer 22.

A developing agent containing a carrier and a toner is accommodated in the developing unit 21, and circulates in a direction perpendicular to the paper of FIG. 1 through rotation of two augers 211, 212. The developing agent in the developing unit 21 is moved to a developing location opposite to the photosensitizer 22 by a developing roll 213 rotating in a direction of arrow B, and the electrostatic latent image on the photosensitizer 22 is developed by the toner in the developing agent to form a toner image on the photosensitizer 22. The toner image formed on the photosensitizer 22 is transferred on the paper P fed, which will be described below through an operation of the transfer unit 113. The toner image on the paper P is heated and pressurized by a fixation unit 114 installed in the printer body 11 to be fixed on the paper P.

A paper cartridge 115 is mounted to a lower portion of the printer body 11 to be freely extractable to the right side of FIG. 1, and several sheets of paper P before printing are stacked and accommodated in the paper cartridge 115. In the printing, the uppermost one P of the papers P accommodated in the paper cartridge 115 is extracted by an extraction roller 116, and even when several sheets of paper P are extracted while being overlapped, only one sheet of paper P is separated by a separation roller 117 with a certainty to be conveyed on a conveying path d1, reaching a registration roll 118. The registration roll 118 corrects a posture of the conveyed paper and adjusts a conveying timing after that, and then, serves to send the paper toward a more downstream side. The paper is sent from the registration roll 118 according to the transfer timing of the toner image on the photosensitizer 22, and the toner image on the photosensitizer 22 is transferred on the paper. The paper to which the toner image has been transferred is conveyed on a conveying path d2 and passes through the fixation unit 114 so that the toner image is fixed thereto, and is discharged onto a paper discharging table 120 installed at an upper portion of the printer body 11 by a paper discharging roll 119.

When both surfaces of a paper are printed, the paper printed on one surface with the above-mentioned way is sent to an intermediate location by the paper discharging roll 119, and thereafter, the paper discharging roll 119 is reversely rotated to convey the paper to a conveying path d3 and the paper reaches the registration roll 118 again. Thereafter, the aforementioned printing operation is repeated, so that the paper whose opposite surfaces have been printed is discharged onto the paper discharging table 120 by the paper discharging roll 119.

A cover 121 of the covers of the printer body 11 is configured to be freely opened and closed in a direction of arrow C-D about a hinge portion 121*a*, that is, on a front surface side of the apparatus. If the cover 121 is opened and a fixing member 26 is rotated in a direction of arrow E while a knob 261 of the semi-cylindrical fixing member 26 installed in the process cartridge 2 is gripped, an attaching opening for attaching the toner cartridge 3 is opened and the toner cartridge 3 can be withdrawn by pulling a knob 32 of the toner cartridge 3. When the toner cartridge 3 is mounted to the process cartridge 2, the reverse manipulation is performed. That is, the toner cartridge 3 is mounted to the process cartridge 2 while the knob 32 of the toner cartridge 3 is gripped by a hand, and the fixing member 26 is rotated in a direction of arrow F while the knob 261 of the fixing member 26 of the process cartridge 2 is gripped by the hand in turn. If the fixing member 26 is rotated in a direction of arrow F, the toner cartridge 3 is fixed to a predetermined location in the process cartridge 2. Thereafter, the cover 121 is closed in a direction of arrow D.

When the process cartridge 2 itself is replaced because, for example, the photosensitizer 22 is deteriorated, the cover 121 is opened, and then the process cartridge 2 is pulled out regardless of whether the toner cartridge 3 exists or not while a knob 27 of the process cartridge 2 is gripped. A new process cartridge 2 can be mounted through a reverse manipulation.

Figure 2:
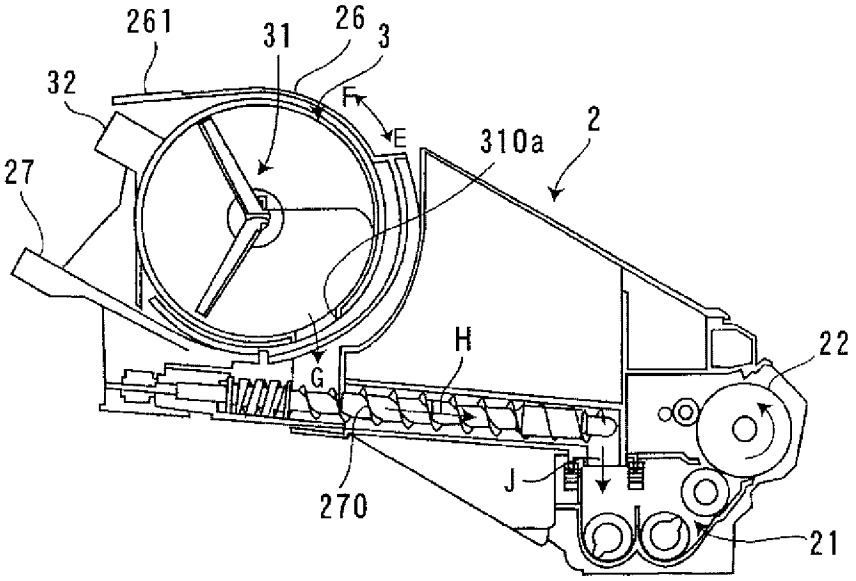
FIG. 2 is a sectional view of a process cartridge, taken along a plane different from that of FIG. 1, when viewed from a rear side of the paper of FIG. 1.

FIG. 2 is a sectional view of the process cartridge, taken along a plane different from that of FIG. 1, when viewed from a rear side of the paper of FIG. 1.

An opening 310*a* for supplying the interior toner toward the developing unit 21 is formed at a lower portion of the toner cartridge 3 in a mounted state of the toner cartridge 3. The opening 310*a* is configured to remain closed by the shutter when the toner cartridge 3 exists as a single body, and the shutter is opened if the fixing member 26 of the process cartridge 2 is rotated in a direction of arrow F as the toner cartridge 3 is mounted to the process cartridge 2. Details of the construction will be described below.

The toner accommodated in the toner cartridge 3 passes through the opening 310*a* and drops in a direction of arrow G, and is moved in a direction of arrow H through rotation of a rotating conveying member 270 and drops in a direction of arrow J to be supplied into the developing unit 21.

Figure 3:
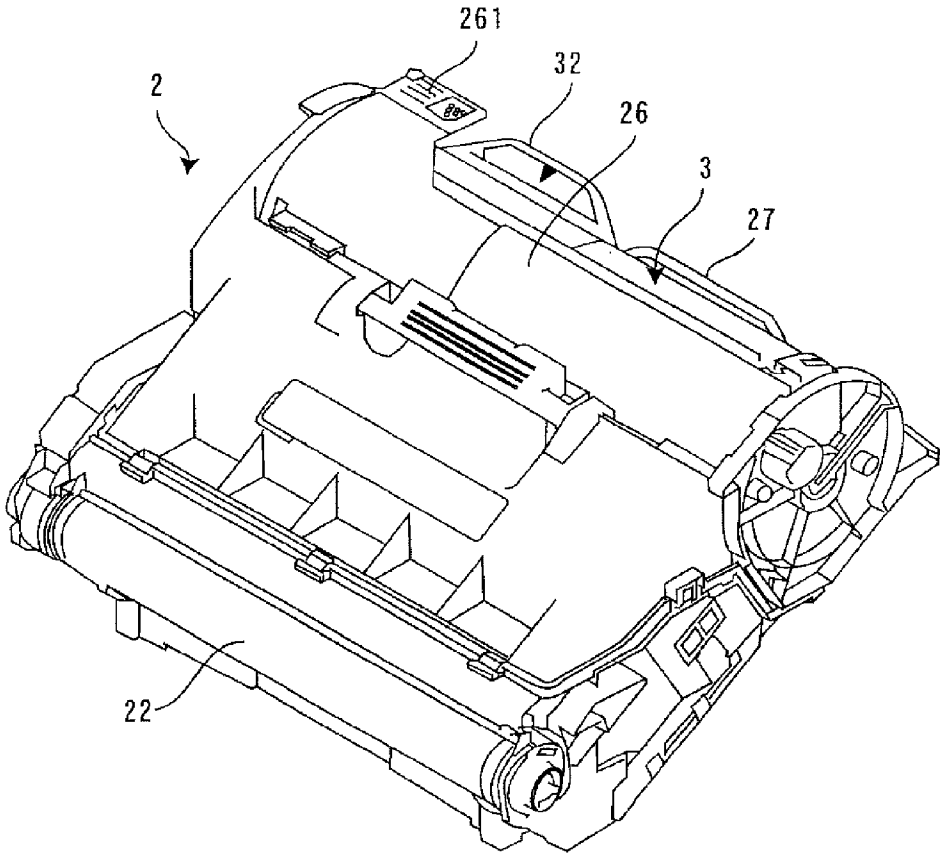
FIG. 3 is a perspective view illustrating an appearance of the process cartridge to which the toner cartridge is mounted, when viewed from a photo sensitizer.

FIG. 3 is a perspective view illustrating an appearance of the process cartridge to which the toner cartridge is mounted, when viewed from a photosensitizer.

FIG. 3 shows the cylindrical photosensitizer 22 on the left lower side, and the toner cartridge 3 and the knob 32 thereof are shown on the right upper side. Almost all parts of the toner cartridge 3 are covered by the semi-cylindrical fixing member 26 installed in the process cartridge 2. In FIG. 3, the fixing member 26 is rotated in the direction of arrow F shown in FIGS. 1 and 2 to be in a state where the toner cartridge 3 is fixed to the process cartridge 2. FIG. 3 also shows the knob 261 for rotating the fixing member 26, and the knob 27 for pulling out the entire process cartridge 2 from the printer body 11 (see FIG. 1).

Figure 4:
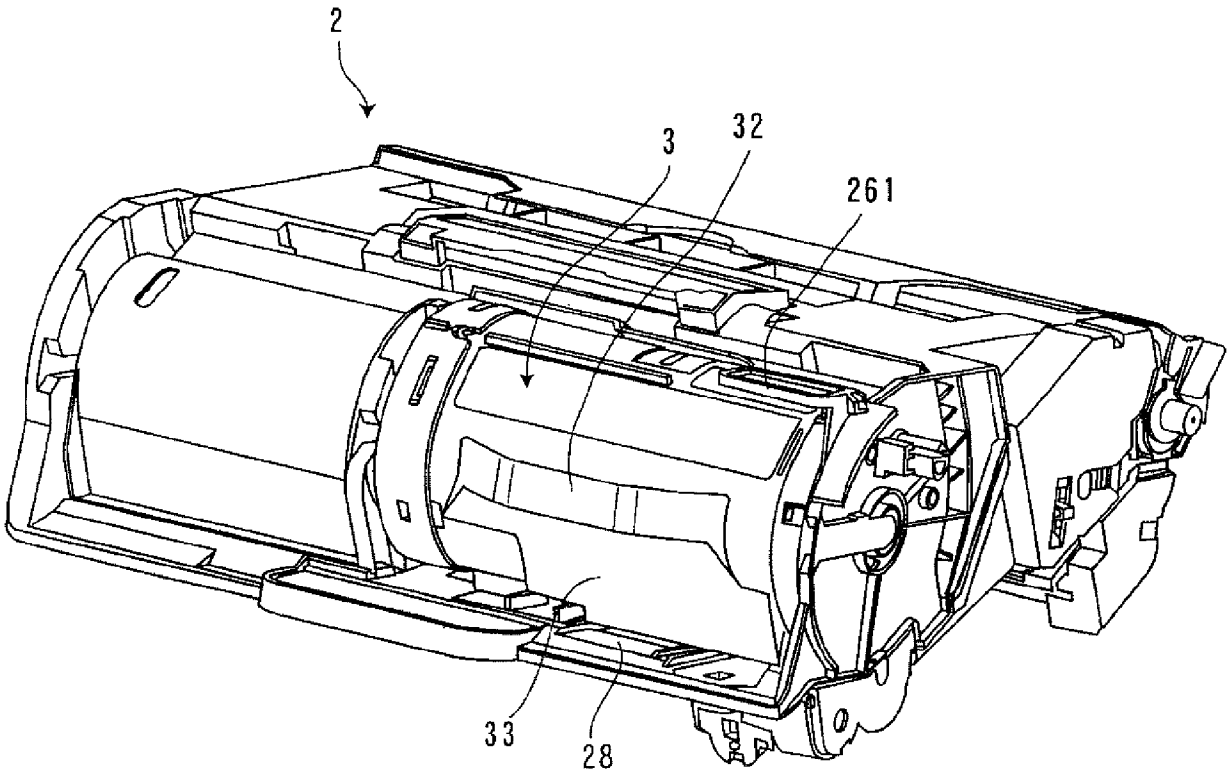
FIG. 4 is a perspective view illustrating an appearance of the process cartridge, when viewed from the toner cartridge mounted to the process cartridge.
Figure 5:
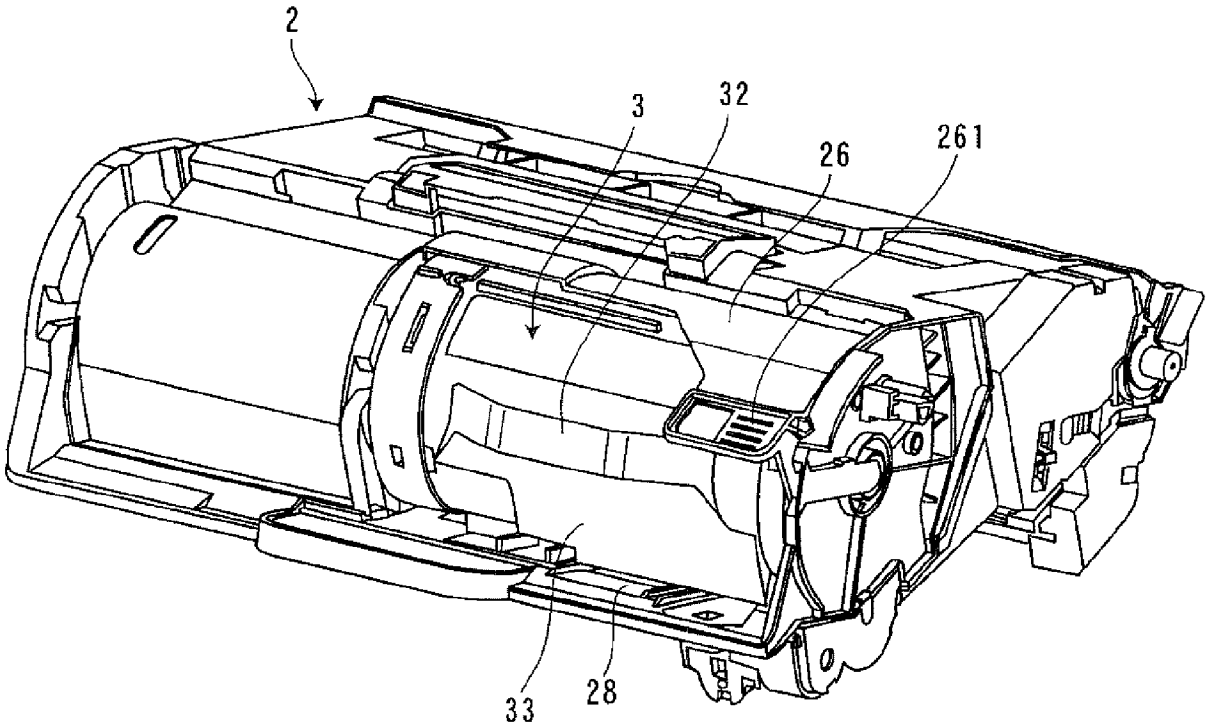
FIG. 5 is a perspective view illustrating an appearance of the process cartridge, when viewed from the toner cartridge mounted to the process cartridge.

FIGS. 4 and 5 are perspective views illustrating an appearance of the process cartridge, when viewed from the toner cartridge mounted to the process cartridge. Here, FIG. 4 is a perspective view illustrating a state where the fixing member 26 still remains opened in the direction of arrow E (see FIGS. 1 and 2) after the toner cartridge 3 is mounted to the process cartridge 2. FIG. 5 is a perspective view illustrating a state where the toner cartridge 3 is fixed to the process cartridge 2 by rotating the fixing member 26 in the direction of arrow F (see FIGS. 1 and 2).

A planar shield 33 is spread out at a lower portion of the knob 32 of the toner cartridge 3. In a state where the toner cartridge 3 is mounted to the process cartridge 2, the shield 33 is spread out to a location close to the bottom 28 of the inner wall surfaces of the process cartridge 2 defining a space for receiving the toner cartridge 3.

Figure 6:
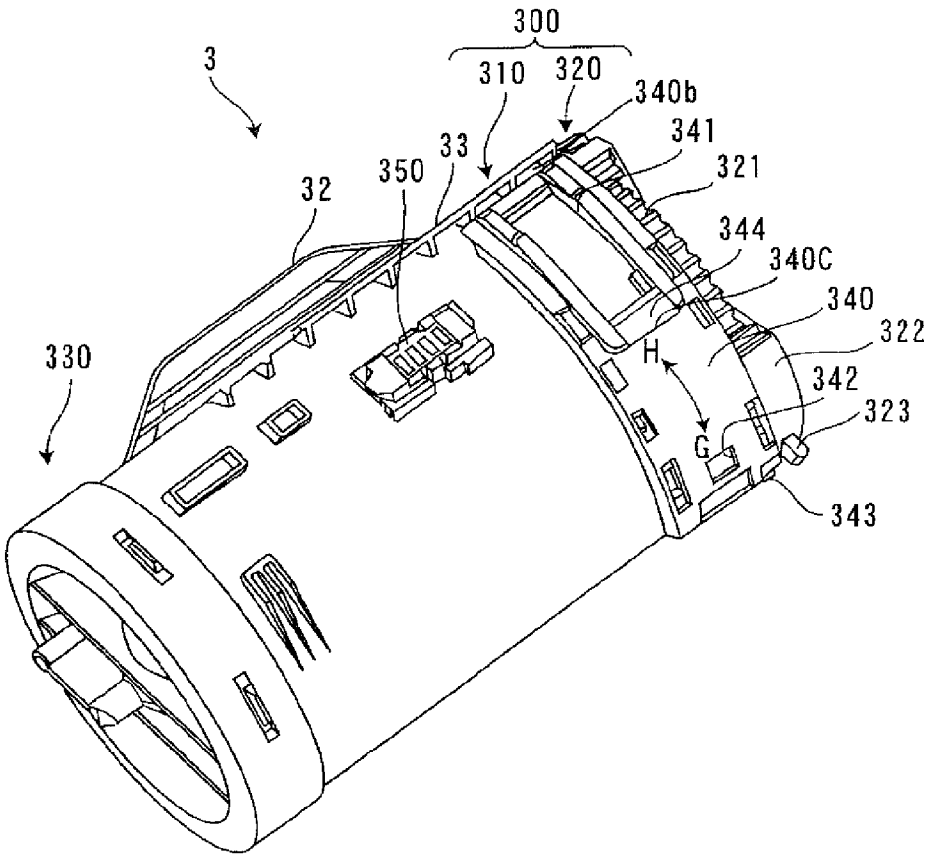
FIG. 6 is a perspective view illustrating an appearance of the toner cartridge as a single body.
Figure 7:
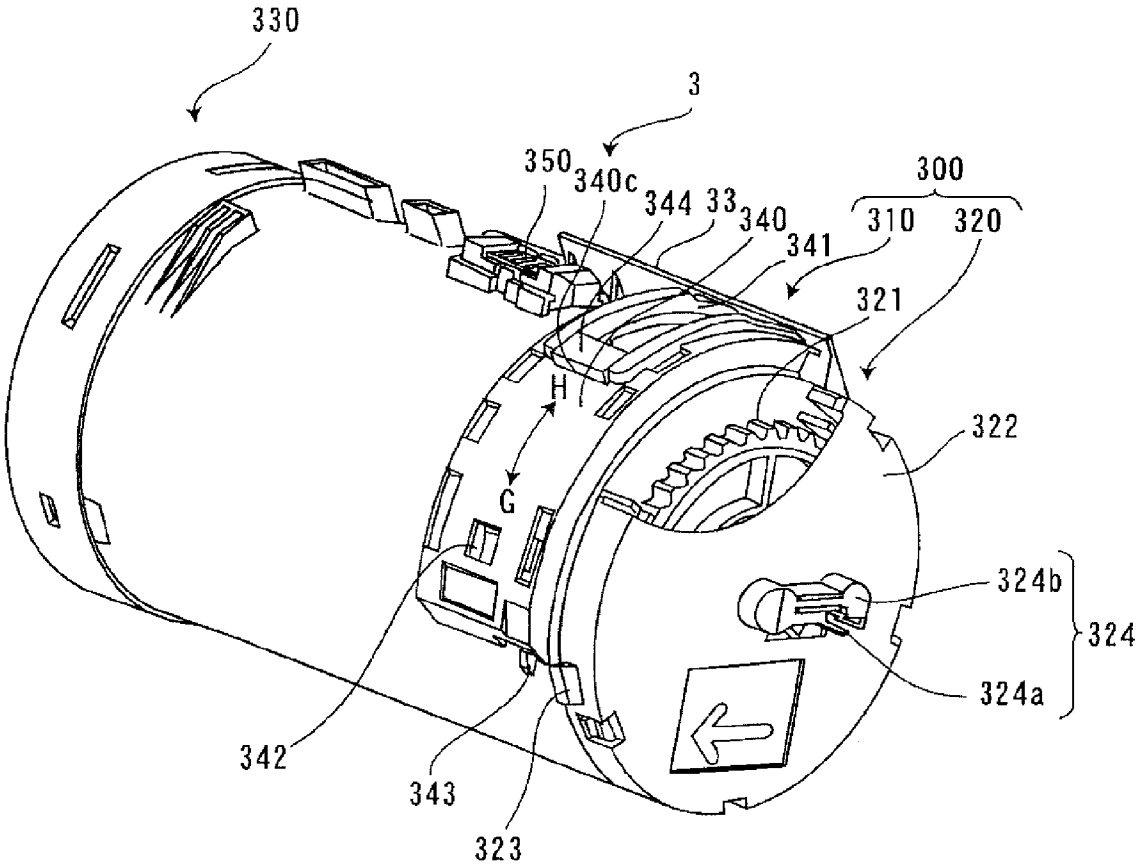
FIG. 7 is a perspective view illustrating an appearance of the toner cartridge as the single body, when viewed from a direction different from that of FIG. 6.

FIGS. 6 and 7 are perspective views illustrating an appearance of the toner cartridge as the single body, when viewed from directions different from each other.

The toner cartridge 3 has a body 310 having a cylindrical inner peripheral surface and an outer peripheral surface which is substantially cylindrical as a whole, and a pair of walls 320 and 330 blocking one end in a longitudinal direction of the substantially cylindrical shape, and an opposite end, respectively. The toner cartridge 3 accommodates the powder toner therein. Here, the first wall 320 blocking the one end forms a container body 300 receiving the toner therein together with the body 310 while the opposite end is opened. The second wall 330 blocking the opening 301 (see FIGS. 16A to 16D) of the container body 300 is a cover blocking the opening 301 after the toner is accommodated in the container body 300.

As shown in FIG. 1, the toner cartridge 3 is mounted to the process cartridge 2 mounted to the printer body 11 in a posture in which a longitudinal direction of the substantially cylindrical shape of the body 310 is a transverse direction.

As described above, a structural body where the process cartridge 2 excluding the toner cartridge 3 is mounted in the printer body 11 is referred to as an apparatus' herein.

The above-mentioned knob 32 is a portion which is gripped for the attachment/detachment of the body 310 to/from the apparatus, and as shown in FIGS. 1, 4, and 5, is installed on an outer peripheral surface of the body 310 at a rear end portion of the apparatus in the mounting direction in a posture in which the body 310 is mounted to the apparatus.

As described above, the shield 33 extends from a lower part of the knob 32 in a posture where the toner cartridge 3 is mounted to the apparatus to a location close to the bottom surface 28 (see FIGS. 4 and 5) of the inner wall surfaces defining the space of the apparatus for receiving the toner cartridge 3.

A shutter 340 is attached to the body 310. The opening 310*a* (see FIGS. 8 and 9) for supplying the toner accommodated in the toner cartridge 3 to the apparatus is formed at a location of the body 310 which is covered by the shutter 340, and the shutter 340 covers the opening 310*a* so that the opening 310*a* is openable and closable.

As shown in FIGS. 6 and 7, the shutter 340 is situated at a closed location where the opening 310*a* is blocked when the toner cartridge 3 is not mounted to the apparatus. When the toner cartridge 3 is mounted to the apparatus, by rotating the fixing member 26, a window 341 formed in the shutter 340 is moved to an opened location overlapping the opening 310*a* in a direction of arrow G, that is, in a direction perpendicular to a longitudinal direction of the body 310 along an outer peripheral surface of the body 310, thereby opening the opening 310*a* of the body 310. If the toner cartridge 3 is mounted, a boss (will be described below) of the fixing member 26 is inserted into a recess 342 of the shutter 340, and the shutter 340 receives a force from the fixing member 26 through a manipulation of rotating the fixing member 26 in the direction of arrow F of FIG. 1 and is moved to the opened location in the direction of arrow G. If the fixing member 26 is manipulated in the direction of arrow E, the shutter 340 receives a force from the fixing member 26 and is moved to the closed location in the direction of arrow E.

A movement blocking hook 343 is installed at a location which corresponds to a front end of the shutter 340 at the closed location as shown in FIGS. 6 and 7, and is the front side than the front end of the shutter 340 at the closed location in a movement direction (of arrow G) from the closed location to the opened location. The movement blocking hook 343 protrudes from the outer peripheral surface of the body 310 in a direction perpendicular to the longitudinal direction of the toner cartridge 3. When the shutter 340 is situated at the closed location, the movement blocking hook 343 interferes with the front end of the shutter 340, and when the toner cartridge 3 is a single body and is not mounted to the apparatus, the movement blocking hook 343 prevents the shutter 340 from being moved from the closed location toward the opened location while serving to stop the shutter 340 at the closed location. If the toner cartridge 3 is mounted to the apparatus, the toner cartridge 3 is pressed by a member of the apparatus and is resiliently deformed and pushed down to a height allowing a movement of the shutter 340 toward the opened location. A resilient body (a sponge 344 in the present embodiment) is installed at a location with which a corner 340*c* of the shutter 340 at the closed location collides. The details thereof will be described below.

A circuit board 350 is disposed on an outer peripheral surface of the body 310 of the toner cartridge 3 in a location parallel to the shutter 340 with respect to a longitudinal direction of the body 310, and the above-mentioned shield 33 is spread out to a location close to the shutter 340 or the circuit board 350. Various data containing, for example, manufacture information of the toner cartridge 3 or consumption of the toner are stored in the circuit board 350.

A gear 321 is installed in the first wall 320 of the toner cartridge 3 constituting the container body 300 together with the body 310, and a cap 322 covers the gear 321 while partially exposing the gear 321. The gear 321 serves to transfer a driving force of the motor 111 shown in FIG. 1 to the agitation member 31 (see FIG. 1) within the toner cartridge 3 and rotate the agitation member 31. Meanwhile, a rotation center axis direction of the agitation member 31 is sometimes referred to simply as a rotation center axis direction.

A boss 323 and a locker 324 are formed in the cap 322.

As shown in FIG. 7, an arrow is marked in the cap 322, by which a mounting direction of the toner cartridge 3 can be viewed by a user.

The boss 323 serves to prevent the shutter 340 from being inclined so that the toner flows down as a corner of the shutter 340 receives an impact when the toner cartridge 3 is carelessly dropped while being discarded, and prevent the shutter 340 from being moved in the opening direction as the movement blocking hook 343 is pushed down due to the impact.

The boss 323 collides with the fixing member 26 (see FIG. 1) of the apparatus when the toner cartridge 3 is mounted to the apparatus and the shutter 340 is moved to an opened location to serve as a stopper for restraining the shutter 340 from moving further. The details of the boss 323 will be described below.

The locker 324 has a first locking portion 324*a* and a second locking portion 324*b*, and serves to prevent the toner cartridge 3 from being withdrawn from the apparatus when the toner cartridge 3 is mounted to the apparatus. Even though a locker also exists in the second wall (cover) 330, the shape thereof is different from that of the first wall 320. The details of the locker will also be described below.

The entire configuration has been described until now, and the characteristic configurations of the parts of the present exemplary embodiment will be described.

(Agitation Member)

Hereinafter, the agitation member 31 (see FIG. 1) disposed within the toner cartridge 3 to agitate the toner in the toner cartridge 3 will be described.

Figure 8:
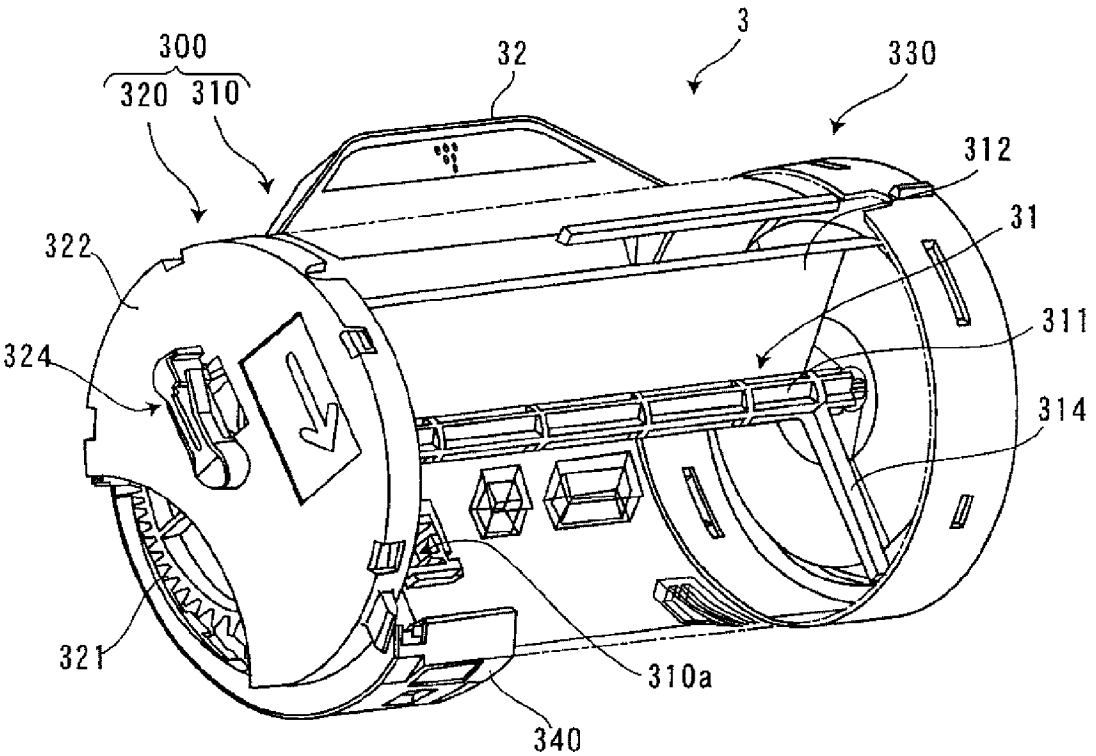
FIG. 8 is a view illustrating an agitation member within the toner cartridge whose body is semitransparent.

FIG. 8 is a view illustrating the agitation member within the toner cartridge whose body is semitransparent.

Figure 9:
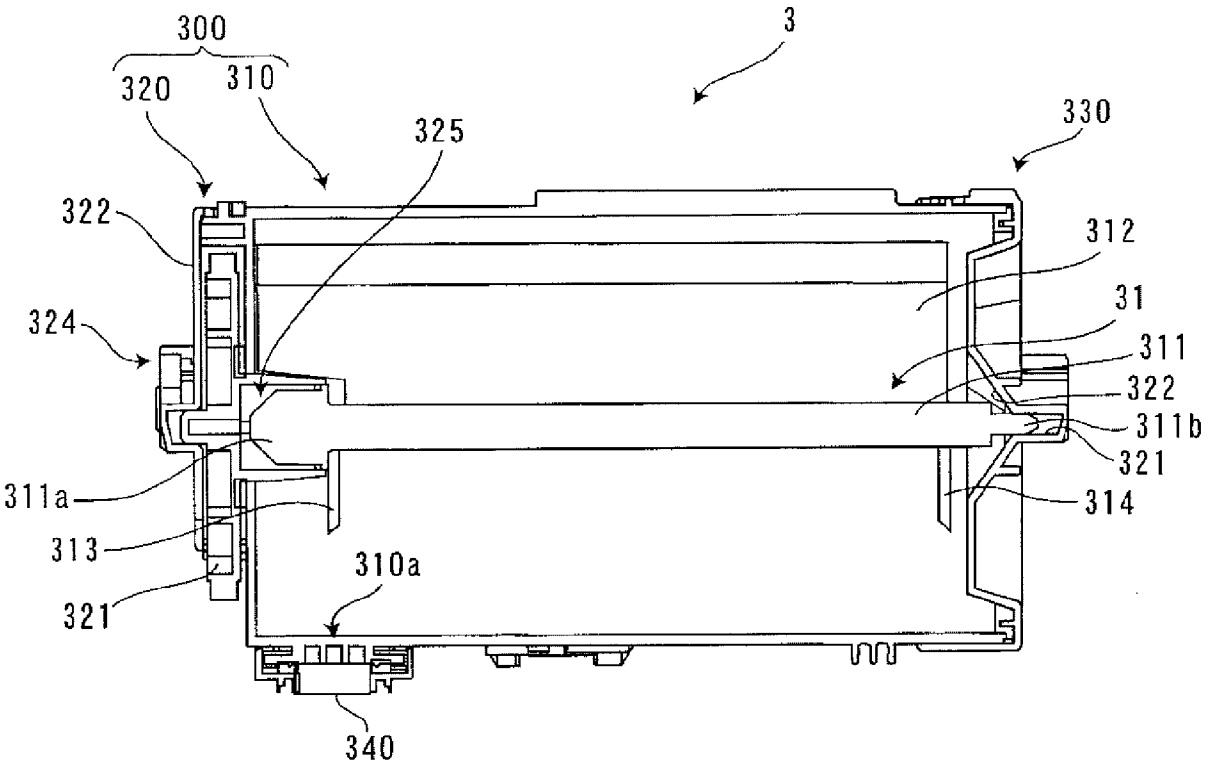
FIG. 9 is a sectional view illustrating the toner cartridge, taken along a plane including the agitation member.

FIG. 9 is a sectional view illustrating the toner cartridge, taken along a plane including the agitation member.

As shown in FIGS. 8 and 9, the agitation member 31 is installed within the toner cartridge 3.

Here, a structure of the agitation member 31 itself will be described, in which case FIGS. 8 and 9 will be referenced if necessary.

Figure 10:
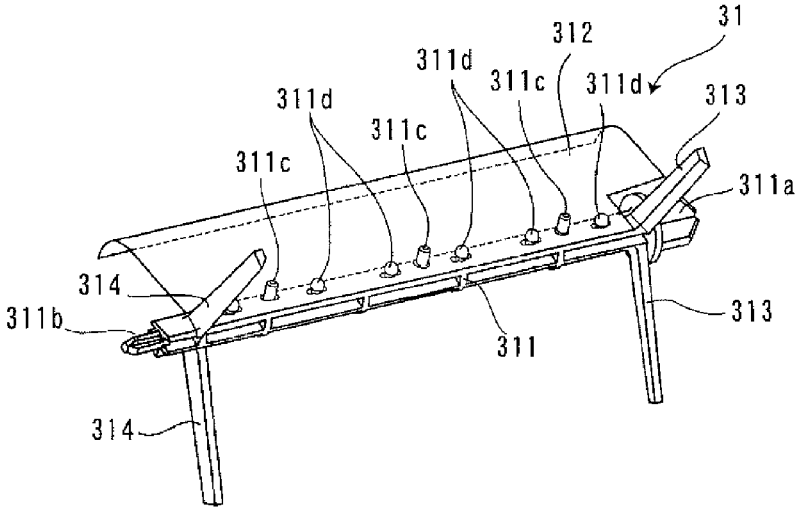
FIG. 10 is a perspective view of the agitation member.
Figure 11:
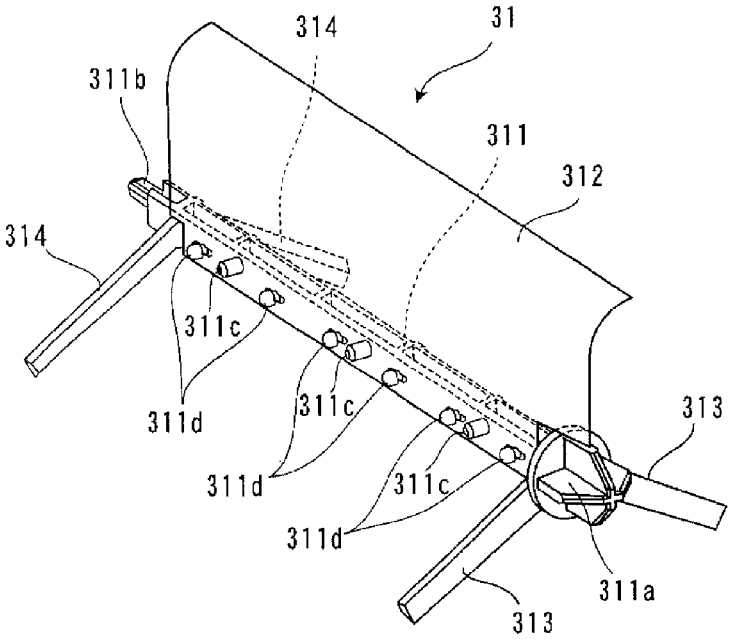
FIG. 11 is a perspective view of the agitation member, when viewed from a view point different from that of FIG. 10.

FIGS. 10 and 11 are perspective views of the agitation member when viewed separately.

The agitation member 31 has a shaft member 311, a sheet member 312, a plurality of first arm members 313 (two first arm members in the present exemplary embodiment), and a plurality of second arm members 314 (two second arm members in the present exemplary embodiment).

As shown in FIGS. 8 and 9, the shaft member 311 is a member extending along a center axis of an inner peripheral surface of the body 310, and has a driving force accommodating portion 311*a* for receiving a driving force from the outside at an end of the shaft member 311 at the first wall 320 side. The shaft member 311 also has a supporting/accommodating portion 311*b* freely rotatably supported by the second wall (cover) 330 at an end of the shaft member 311 at the second wall (cover) 330 side. The shaft member 311 receives a driving force through the driving force accommodating portion 311*a* to be rotated.

The sheet member 312 constituting the agitation member 31 is a flexible plastic film spread out in a direction from one wall 320 of the body 310 toward another wall (cover) 330 along the shaft member 311 to be supported by the shaft member 311. The sheet member 312 is also spread out in a radial direction from the shaft member 311 toward the inner peripheral surface of the body 310, and is rotated as the shaft member 311 rotates, thereby agitating the toner accommodated in the toner cartridge 3. The sheet member 312 is formed longer than a distance from the shaft member 311 to the inner peripheral surface of the body 310 so as to always contact the inner peripheral surface of the body 310 when the shaft member 311 is rotated. FIGS. 10 and 11 where a tip radial portion of the sheet member 312 is curved shows that the tip portion of the sheet member 312 is rotated while contacting the inner peripheral surface of the body 310, resulting in a shown curve.

A portion of the shaft member 311 supporting the sheet member 312 corresponds to a plane, and a positioning boss 311*c* and a fixing boss 311*d* are installed on the plane. A hole is formed at a location of the sheet member 312 corresponding to the bosses 311*e* and 311*d*, and the positioning boss 311*c* is inserted into the sheet member 312 to position the sheet member 312 and the fixing boss 311*d* is inserted into the sheet member 312 to fix the sheet member 312 to the shaft member 311.

The first arm member 313 is a member extending from the shaft member 311 toward the inner peripheral surface of the body 310 at a location closer to the first wall 320 than a longitudinal center of the shaft member 311 and configured to be rotated integrally with the shaft member 311. In the present exemplary embodiment, either of the first arm member 313 and the second arm member 314 to be described below is formed with one resin part integrally formed with the shaft member 311.

The plurality of first arm members 313 extend from a direction different from a direction which the front end of the sheet member 312 faces and also extend different directions from each other with respect to a rotating direction of the shaft member 311. In detail, in the present exemplary embodiment, the sheet member 312 and the two first arm members 313 are formed radially in directions spaced apart from each other by 120 degree with respect to the rotating direction of the shaft member 311.

The second arm member 314 is a member extending from the shaft member 311 toward the inner peripheral surface of the body 310 at a location closer to the second wall (cover) 330 than a longitudinal center of the shaft member 311 and configured to be rotated integrally with the shaft member 311.

As described above, in the present exemplary embodiment, as in the first arm member 313, the second arm member 314 is a part integrally formed with the shaft member 311.

The plurality of second arm members 314 extend along a direction different from a direction where the front end of the sheet member 312 faces and also different from a rotating direction of the shaft member 311. In detail, in the present exemplary embodiment, the two second arm members 314 extend in the same directions as the two first arm members 313, respectively. That is, the sheet member 312 and the two second arm members 314 are formed radially in directions spaced apart from each other by 120 degree with respect to the rotating direction of the shaft member 311.

Meanwhile, the lengths of the first arm member 313 and the second arm member 314 are shorter than a distance from the shaft member 311 to the inner peripheral surface of the body 310.

Figure 12:
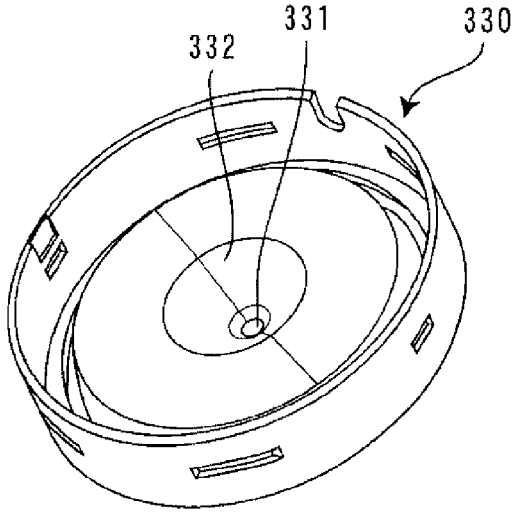
FIG. 12 is a perspective view of a cover constituting a second wall of the toner cartridge, when viewed from an inner surface thereof.

FIG. 12 is a perspective view of a cover constituting the second wall of the toner cartridge, when viewed from an inner surface thereof.

The cover is a member which covers the container body 300 to form the second wall 330 (see FIGS. 6 to 9) after the agitation member 31 is inserted into the container body 300 of the toner cartridge 3 from the opening 301 and the toner is filled from the opening 301. A support hole 331 as an example of a support portion for freely rotatably supporting the supporting/accommodating portion 311*b* of the shaft member 311 constituting the agitation member 31 is formed at a center of the inner surface of the cover. A conically inclined guide surface 332 for guiding the supporting/accommodating portion 311*b* of the shaft member 311 to the support hole 331 is formed at a circumference of the support hole 331 to be recessed toward the support hole 331.

Meanwhile, as shown in FIG. 9, a driving force transferring mechanism 325 for transferring a driving force transferred to the gear 321 to the driving force accommodating portion 311*a* of the shaft member 311 is installed on the first wall 320.

The agitation member 31 is inserted into and installed within the container body 300 whose second wall (cover) 330 is opened in a direction in which the driving force accommodating portion 311*a* of the shaft member 311 is engaged with the driving force transferring mechanism 325.

In a state where the agitation member 31 is installed within the container body 300, as the sheet member 312 contacts the inner peripheral surface of the body 310, the shaft member 311 receives a force in a direction far away from the center of the body 310. Then, the second arm member 314 supports the shaft member 311 lest the shaft member 311 should fall down from the center of the substantially cylindrical shape of the body 311 to a high degree. In more detail, in a state where the second arm member 314 and the inner peripheral surface of the body 310 contact each other, the supporting/accommodating portion 311*b* is located within a diameter of the inclined guide surface 332. If the second wall (cover) 330 is mounted in this state, the supporting/accommodating portion 311*b* of the shaft member 311 is guided by the inclined guide surface 332 to enter the support hole 331, and thus become freely rotatably supported by the support hole 331. The agitation member 31 receives a driving force transferred through the gear 321 to the driving force accommodating portion 311*a* to be rotated, and agitates the interior toner. Then, the first arm member 313 and the second arm member 314 are rotated integrally with the shaft member 311. Meanwhile, since the lengths of the first arm member 313 and the second arm member 314 are shorter than a distance from the shaft member 311 to the inner peripheral surface of the body 310, none of the first arm member 313 and the second arm member 314 contacts the inner peripheral surface of the body 310 (while the shaft member 311 rotates. Here, the toner cartridge 3 is mounted to the apparatus in a posture where a longitudinal direction thereof is a transverse direction to be used in the apparatus in the posture, but may sometimes be in a posture where the longitudinal direction of the toner cartridge 3 is a longitudinal direction, when the toner cartridge 3 is a single body, for example, when the toner cartridge 3 is conveyed or kept. In this case, the interior toner may be pressed downward to cohere. In the present exemplary embodiment, since the first arm member 313 and the second arm member 314 are installed at a location close to the first wall 320 and the second wall 330, the cohered toner is collapsed by one of the first arm member 313 and the second arm member 314 where the toner is cohered if the agitation member 31 is rotated when the toner starts to be used.

As shown in FIG. 8, in the body 310 constituting the body container 300, an opening 310*a* for supplying the interior toner toward the apparatus is formed at a location below the shaft member 311 in a posture where the container body 300 is mounted to the apparatus, and the opening 310*a* is blocked by the shutter 340. Here, as shown in FIG. 9, a fixed location of the first arm member 313 to the shaft member 311 is predetermined to pass by a location facing the opening 310*a* when the agitation member 31 is rotated. As the first arm member 313 passes by the location facing the opening 310*a*, the cohered toner is prevented from staying in the vicinity of the opening 310*a*. Meanwhile, in the present exemplary embodiment, the first arm member 313 extends from the same location of the shaft member 311 with respect to a longitudinal direction of the shaft member 311. Accordingly, both the two first arm member 313 passes by a location facing the opening 310*a*. In this case, the two first arm members 313 may extend from separate locations with respect to the longitudinal direction of the shaft member 311, such that only one of the first arm members 313 may pass by the location facing the opening 310*a*.

Meanwhile, herein, the arm members are installed at opposite ends of the shaft member 311, but may be installed not at the opposite ends of the shaft member 311 but, for example, in the vicinity of the center of the shaft member 311 and support the shaft member 311 lest the shaft member 311 should fall down to a high degree during the assembly thereof.

Figure 13:
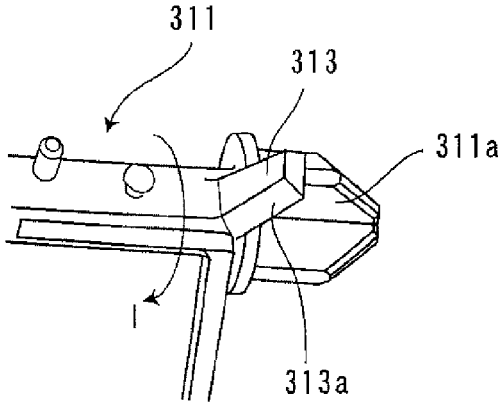
FIG. 13 is a partially enlarged perspective view of a driving force receiving part of a resin molded product constituting the agitation member.
Figure 14:
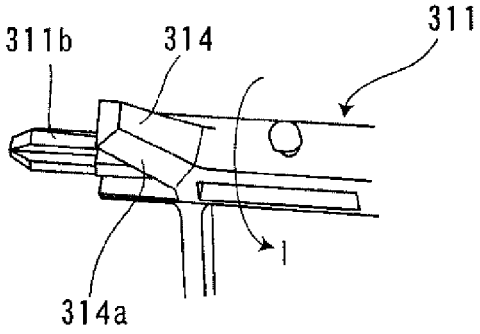
FIG. 14 is a partially enlarged perspective view of a supported part of the resin molded product constituting the agitation member.

FIGS. 13 and 14 are partially enlarged perspective views of the driving force receiving part and supported part of resin molded products constituting the agitation member, respectively.

Arrow 1 of FIGS. 13 and 14 denotes a rotating direction of the shaft member 311.

As shown in FIGS. 13 and 14, the first arm member 313 and the second arm member 314 have inclined surfaces 313*a* and 314*a*, respectively. The inclined surfaces 313*a* and 314*a* generate partial forces pressing the interfered toner to a vicinity of the center of the shaft member 311 in the rotating center line direction when rotated in the direction of the arrow I. As described above, if the toner cartridge 3 is laid in a posture where the rotation center axis extends longitudinally, the interior toner may be pressed downward to show a sign to cohere. If the inclined surfaces 313*a* and 314*a* are formed in the first arm member 313 and the second arm member 314, a partial force pressing the toner toward a direction in which the toner which shows a sign to cohere during the rotation of the agitation member 31 becomes far away from the end, that is, to the vicinity of the center in the direction of the rotation center axis of the shaft member 311 is generated, moving the toner to the vicinity of the center of the shaft member 311. A rotating torque of the shaft member 311 is reduced as compared with the case where the toner is agitated by an arm member without any inclined surface.

Meanwhile, in the present exemplary embodiment, even though the inclined surfaces 313*a* and 314*a* are formed in all of the two first arm members 313 and the two second arm members 314, inclined surfaces may be formed in only one of the two first arm members 313 and only one of the two second arm members 314.

Figure 15:
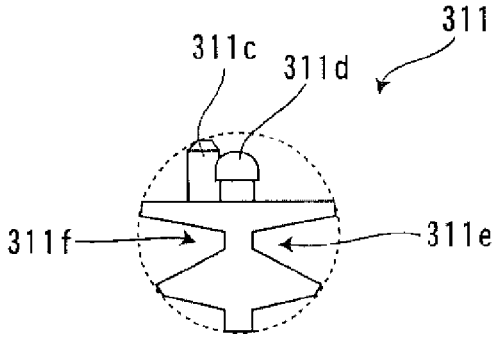
FIG. 15 is a view illustrating a shaft member constituting the agitation member, taken along a plane whose perpendicular corresponds to a direction in which the shaft member extends.

FIG. 15 is a view illustrating the shaft member constituting the agitation member, taken along a plane whose perpendicular corresponds to a direction in which the shaft member extends.

The shaft member 311 has recesses 311*e* and 311*f* to reduce materials and make weight light. The recesses 311*e* and 311*f* have a shape which becomes narrower as it goes to a vicinity of the center axis of the shaft member 311 and becomes opened wider as it goes to the outside of the shaft member 311. This shape is also designed to prevent the toner from cohering. That is, even when the toner having entered the recesses 311*e* and 311*f* shows a sign to cohere, since the recesses 311*e* and 311*f* have a shape which becomes opened wider as it becomes farther away from the shaft center, the toner in the recesses 311*e* and 311*f* is apt to be moved outward while restraining the recesses 311*e* and 311*f* from being filled with the cohered toner.

FIGS. 16A to 16D are schematic diagrams illustrating a toner cartridge assembling process. However, a process of charging the toner is omitted herein.

Figure 16A:
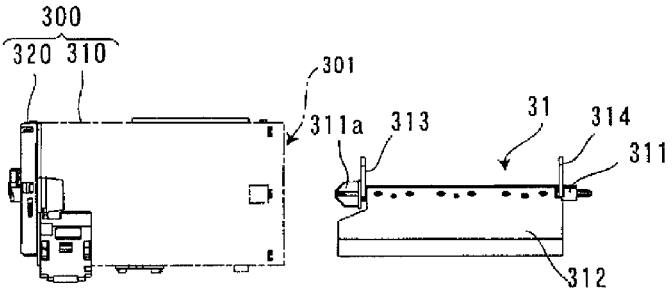
FIGS. 16A to 16D are schematic diagrams illustrating an assembly process for the toner cartridge.
Figure 16B:
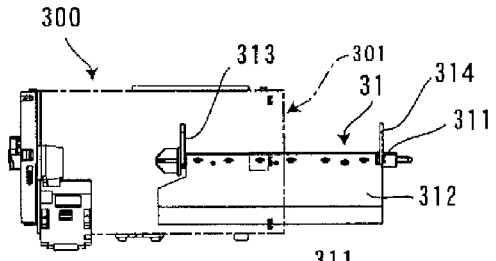

In assembling the toner cartridge, the agitation member 31 including the body 310 and the first wall 320 blocking one end thereof is inserted into the container body 300 from the opening 301 at one end, starting from the driving force accommodating portion 311*a* of the shaft member 311 (FIGS. 16A and 16B)

Figures 1, 16C:
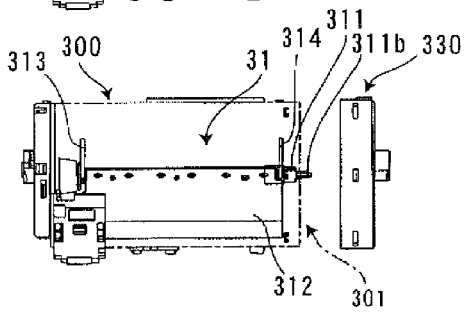
Figures 2, 16C:
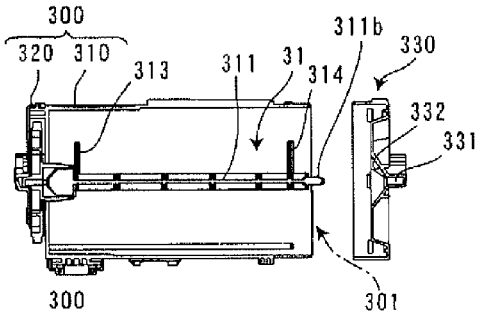
Figure 16D:
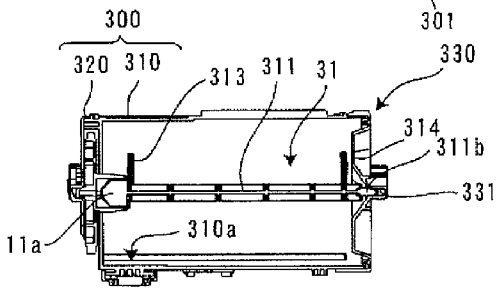

Even though only one end of the shaft member 311 on a driving force accommodating portion 311*a* side is supported and the supporting/accommodating portion 311*b* is not supported in a state where the agitation member 31 is inserted into the container body 300, the supporting/accommodating portion 311*b* of the shaft member 311 is maintained in a vicinity of the center of the body 310 by the operations of the sheet member 312 and the second arm member 314 (FIGS. 16C-1 and 16C-2). Meanwhile, as in FIGS. 16A and 16B, FIG. 16C-1 is a view illustrating the body 310 being transparent, and FIG. 16C-2 is a sectional view in the same state of FIG. 16C-1. Thus, when the second wall (cover) 330 is mounted, the supporting/accommodating portion 311*b* is guided by the inclined guide surface 332 of the second wall (cover) 330 to enter the support hole 331 while being supported freely rotatably.

Figure 17:
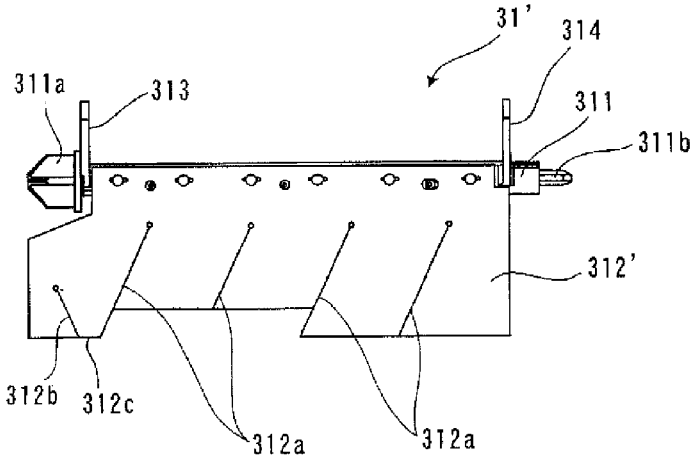
FIG. 17 is a view illustrating a modification of the agitation member.

FIG. 17 is a view illustrating a modification of the agitation member.

A difference between the agitation member 31' shown in FIG. 17 and the agitation member 31 described until now lies in the sheet member 312'.

An oblique cutting line 312*a* is formed in the sheet member 312'. By forming the cutting line 312*a* in a direction shown in the drawing, a force moving the toner from the supporting/accommodating portion 311*b* toward the driving force accommodating portion 311*a* is generated when the agitation member 31' is rotated with the shaft member 311 being transversely. Due to this, in the present exemplary embodiment, since the opening 310*a* (see FIG. 8) for supplying the toner to the apparatus is formed on the driving force accommodating portion 311*a* side, the toner is moved toward the opening 310*a*.

The sheet member 312' is long on the supporting/accommodating portion 311*b* side and becomes shorter to a degree at an intermediate location with respect to a length (a length in a direction far away from the shaft member 311) of the body 310 in a direction facing the inner peripheral surface of the body 310. This helps the toner on the supporting/accommodating portion 311*b* side move toward the opening 310*a* (see FIG. 8) more strongly.

The sheet member 312' has a cutting line 312*b* formed obliquely opposite to the cutting line 312*a*, and accordingly, an apex portion 312*c* opposite sides of which are cut to have a substantially triangular shape is formed in the driving force accommodating portion 311*a* side. The apex portion 312*c* is formed at the same location as the first arm member 313 with respect to a longitudinal direction of the shaft member 311. As in the above-described embodiment, the first arm member 313 passes by a location facing the toner supplying opening 310*a* to be rotated. Thus, the apex portion 312*c* of the sheet member 312' also passes through the opening 310*a*. The sheet member 312' has length by which the sheet member 312' is rotated while contacting the inner peripheral surface of the body 310, and accordingly, the apex portion 312*e* passes through the opening 310*a* in a fashion where the apex portion 312*e* enters into the opening 310*a*. If the apex portion 312*c* is formed, a force for pushing the toner inside the opening 310*a* out from the opening 310*a* is applied.

(Boss)

As shown in FIG. 7 which has been described above, the boss 323 is formed in a cap 322 constituting an outer wall surface of the first wall 320.

Figure 18:
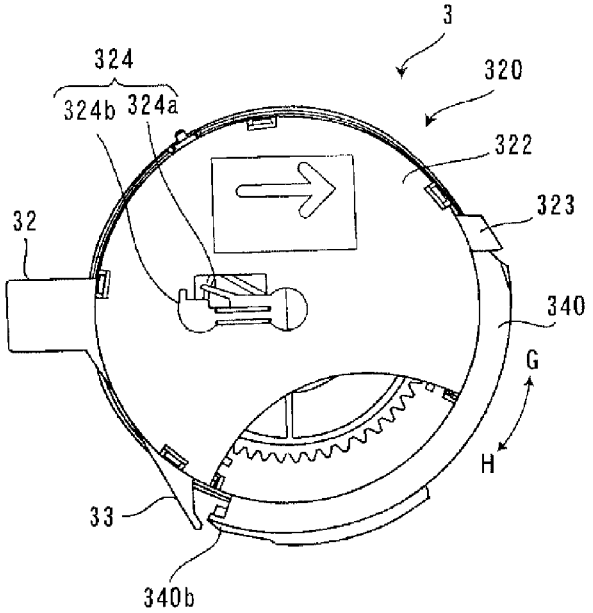
FIG. 18 is a side view of a boss, when viewed from a first wall along a rotation center axis.
Figure 19:
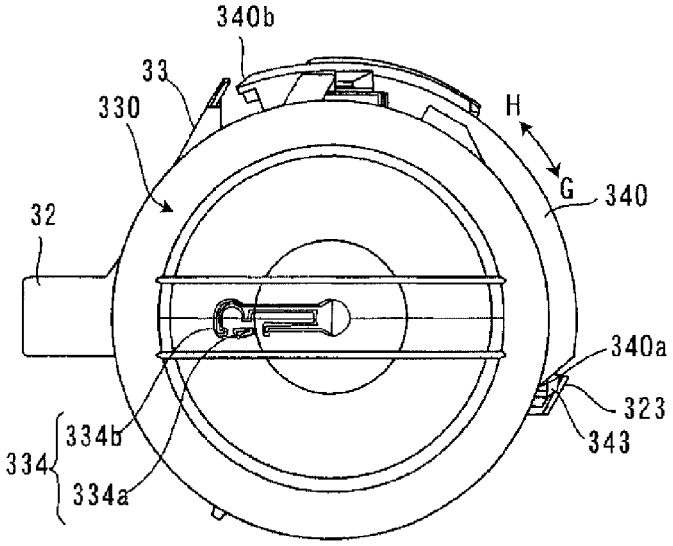
FIG. 19 is a side view of the boss, when viewed from the second wall (cover) along the rotation center axis.

FIG. 18 is a side view of the boss 323, when viewed from the first wall along a rotation center axis. FIG. 19 is a side view of the boss 323, when viewed from the second wall (cover) along a rotation center axis.

Figure 20:
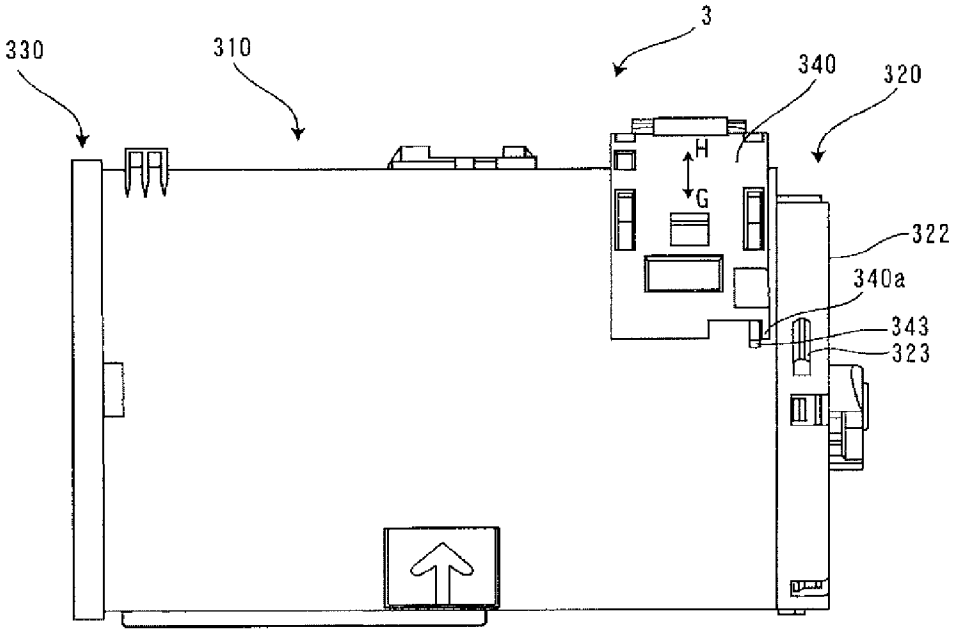
FIG. 20 is a plan view of the boss, when viewed from a front end of the boss.

FIG. 20 is a plan view of the boss 323, when viewed from a front end of the boss. As shown in FIGS. 7 and 20, the boss 323 is situated at a location between the shutter 340 and the outer wall surface of the first wall 320 with respect to a longitudinal direction of the substantially cylindrical body 310 and parallel to the front end in the movement direction (a direction of arrow G) facing the opened location of the shutter 340 at the closed location with respect to the rotating direction about the rotation center being the shaft member 311. As can be seen from FIG. 19, the boss 323 has a rotational width also parallel to the above-described movement blocking hook 343 together with the front end of the shutter 340. As can be seen from FIGS. 18 and 19, the boss 323 protrudes to the radially outward direction higher than the movement blocking hook 343 with respect to the radial direction from the rotation center axis of the body 310.

While it is difficult to leak the interior toner when the entire shutter 340 is pressed from the outer surface thereof, a portion of the shutter 340 distant from a corner portion of the shutter 340 may show a sign to float if the corner portion of the shutter 340 is pressed, causing the interior toner to be leaked therefrom.

Here, the boss 323 is formed in the vicinity of the corner portion 340*a* of the shutter 340, and when the toner cartridge 3 drops while the corner portion 340*a* of the shutter 340 faces downward, the boss 323 receives an impact due to the drop lest the portion of the shutter 340 distant from the corner portion 340*a* should float as the corner portion 340*a* of the shutter 340 is pressed.

The movement blocking hook 343 serves to leave the shutter 340 at a closed location when the toner cartridge 3 is a single body, and serves to allow movement of the shutter 340 as the movement blocking hook 343 is pressed toward the radially inner side when mounted to the apparatus. Thus, for example, if the movement blocking hook 343 is pressed due to a drop, the shutter 340 turns into a state where the shutter 340 can be moved toward the opened location, and the shutter 340 is moved toward the opened location to a degree by a drop impact, and the like, possibly causing the toner exiting from the opening 310*a* (see FIGS. 8 and 16) of the body 310 to be leaked.

The boss 323 according to the present exemplary embodiment prevents the movement blocking hook 343 from being pressed due to a drop impact, and the like in relation to the movement blocking hook 343.

After the toner cartridge 3 is mounted to the apparatus, the shutter 340 is moved from the closed location to the opened location due to rotation of the fixing member 26 (see FIG. 1) of the apparatus in the direction of arrow F. When the shutter 340 is moved to the opened location, the boss 323 collides with the fixing member 26 of the apparatus, serving as a stopper for blocking a further movement of the shutter 340 in a direction where the shutter 340 is further opened. This aspect will be described below.

As shown in FIGS. 7 and 8, the locker 324 having the first locking portion 324*a* and the second locking portion 324*b* is formed in the cap 322 constituting the first wall 320. Likewise, as shown in FIG. 19, a locker 334 having a first locking portion 334*a* and a second locking portion 334*b* is also formed in the second wall (cover) 330.

The first locking portion 324*a* of the first wall 320 has a cantilever-shaped shape extending along an outer surface of the cap 322, that is, a plane crossing the rotation center axis, and the first locker portion 334*a* of the second wall (cover) 330 has a cantilever-shape protruding in a direction parallel to the rotation center axis from the second wall (cover) 330. The details of the lockers 324 and 334 will be described below.

(Shield)

As shown in FIGS. 4 to 7, the shield 33 is formed in the body 310 of the toner cartridge 3.

The shield 33 forms a plane forming a portion of the outer surface of the body 310 below the knob 32 in a posture where the shield 33 is mounted to the apparatus (see FIGS. 4 and 5). The shield 33 is formed on a plane to be easily formed of a resin.

The shield 33 is spread out to a location of the shutter 340 in the closed location which is close to the end 340*b* (see FIGS. 7, 18, and 19) of the knob 32 side with respect to the rotating direction and higher than the end 340*b* of the knob 32 side of the shutter 340 with respect to a radial direction from the rotation center axis, forming a portion of the outer surface of the body 310. Thus, the shield 33 prevents an impact from being applied to the end 340*b* of the shutter 340 during a drop.

The shield 33 is spread out to both the location parallel to the shutter 340 and the location parallel to the circuit board 350 with respect to the rotation center axis direction. Accordingly, the shield 33 serves to divide a region which can be contacted by a hand of a user and a region where the shutter 340 or the circuit board 350 is disposed lest the hand gripping the knob 32 should carelessly contact the shutter 340 or the circuit board 350.

As described with reference to FIGS. 4 and 5, when the toner cartridge 3 is mounted to the apparatus, the shield 33 is spread out to a location close to the bottom surface 28 (see FIGS. 4 and 5) of the inner wall surfaces of the apparatus defining a space receiving the toner cartridge 3. Thus, if the toner cartridge 3 is mounted to the apparatus, the opening 310*a* or the circuit board 350 cannot be seen even if viewed by the user from the mounting direction of the toner cartridge 3, as the shield 33 shields between the outside of the apparatus and the circuit board 350. The circuit is prevented from being electrostatically damaged as a finger approaches the circuit board 350 and the Eke by preventing the finger from entering a gap between the shield 33 and the bottom surface 28.

(Shape of Opening)

Figure 21:
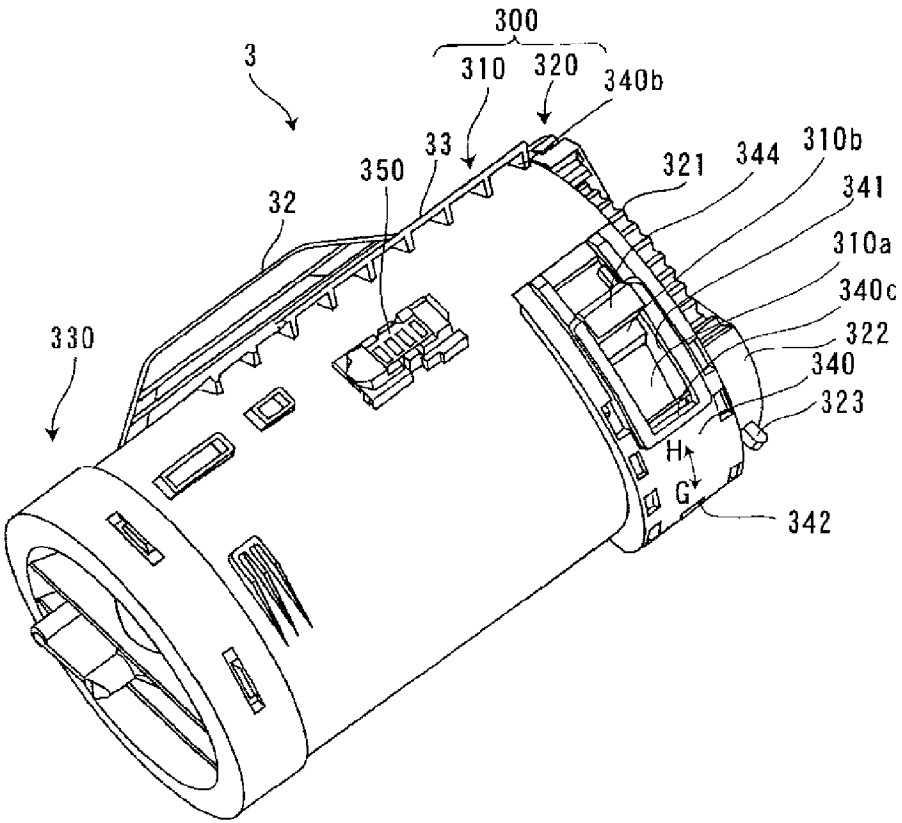
FIG. 21 is a perspective view of the toner cartridge when a shutter is in an opened location.

FIG. 21 is a perspective view of the toner cartridge when the shutter is in the opened location. The toner cartridge when the shutter is in the closed location is shown in FIG. 6.

Meanwhile, the shutter opening/closing mechanism will be described below, and it is considered that the shutter can be opened and closed.

Figure 22:
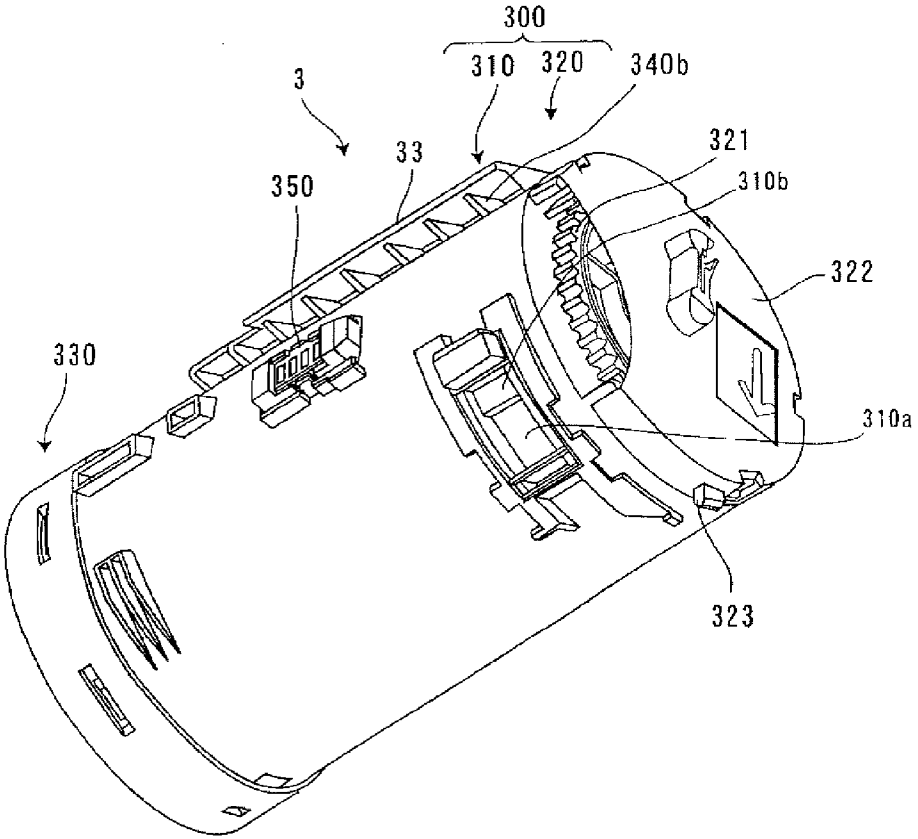
FIG. 22 is a perspective view illustrating a state where an opening portion of the body is exposed by removing the shutter itself from the toner cartridge.

FIG. 22 is a perspective view illustrating a state where an opening portion of the body is exposed by removing the shutter itself from the toner cartridge.

Figure 23:
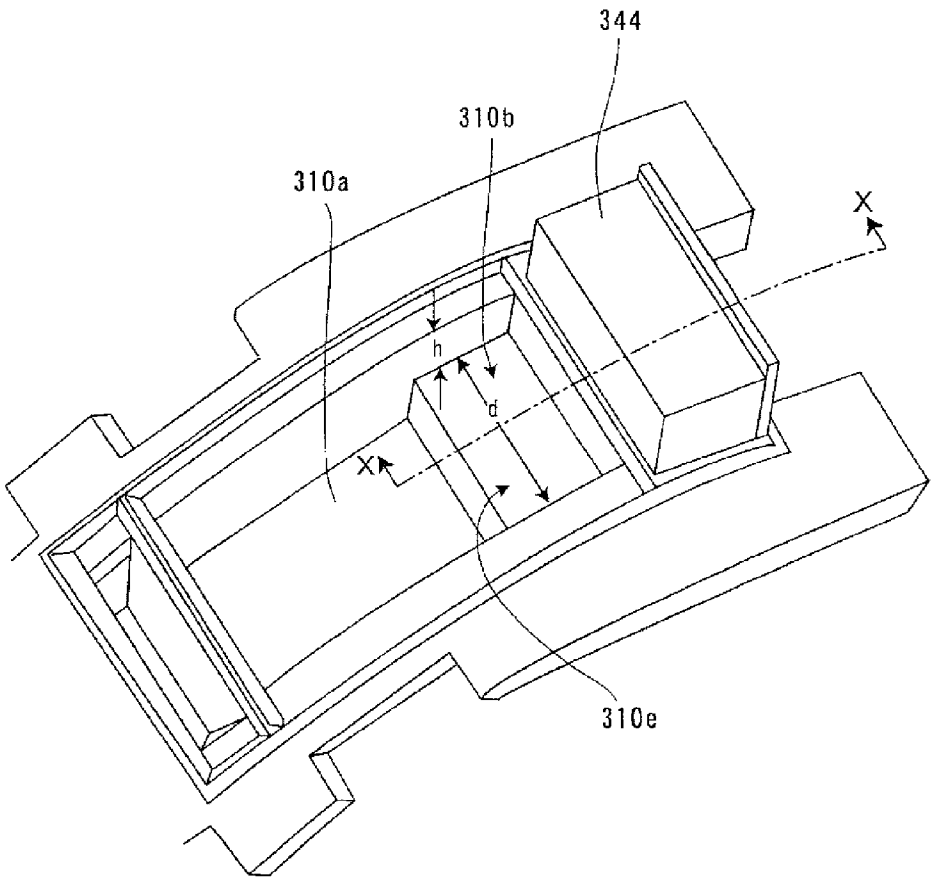
FIG. 23 is an enlarged perspective view of the opening portion formed in the body.
Figure 24:
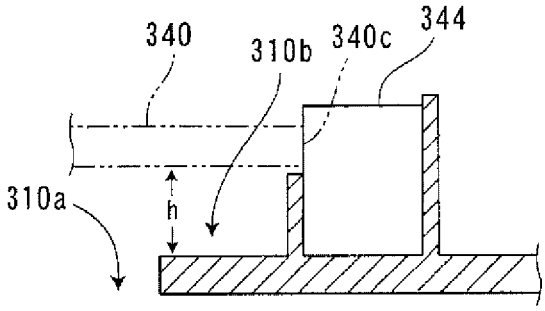
FIG. 24 is a sectional view taken along arrow X-X shown in FIG. 23.

FIG. 23 is an enlarged perspective view of the opening portion formed in the body. FIG. 24 is a sectional view taken along arrow X-X shown in FIG. 23.

As shown in FIG. 8, the opening 310*a* for supplying the toner inside the toner cartridge 3 to the apparatus is formed at a location of the body 310 of the toner cartridge 3 which is below the rotation center axis when the toner cartridge 3 is in a posture where the toner cartridge 3 is mounted to the apparatus and close to the first wall 320. A storage chamber 310*b* for storing the toner flowed in the movement direction thereof by the shutter 340 is formed in the body 310 on a front side in the movement direction (a direction of arrow H) in which the shutter 340 is moved from the opened location shown in FIG. 21 toward the closed location shown in FIG. 6 with respect to the opening 310*a*. The storage chamber 310*b* is covered by the shutter 340 having moved to the closed location.

In this way, by installing the storage chamber 310*b* at the location, even when the toner is flowed in the movement direction of the shutter 340 by the shutter 340 facing from the opened location to the closed location, the flowed toner is stored in the storage chamber 310*b*, and is prevented from being leaked to the outside.

As shown in FIG. 23, the storage chamber 310*b* has the same width d as that of the opening 310*a* with respect to the rotation center axis direction, and has a passage 310*e* opened over an entire width d in the rotation center axis direction and an entire radial height h of the storage chamber 310*b* from the rotation center axis in the movement direction of the shutter 340, between the storage chamber 310*b* and the opening 310*a*. Since the passage 310*e* is opened in this way, the toner is prevented from being moved toward the opening 310*a* and being overflowed to the outside even when the storage chamber 310*b* is fully filled with the toner.

Since a resilient member (a sponge 344 in the present exemplary embodiment) is disposed on a front side of the storage chamber 310*b* in the movement direction in which the shutter 340 is moved from the opened location toward the closed location, the resilient member 344 contacts the corner 340*c* of the shutter 340 having moved to the closed location. As the sponge 344 is disposed, the toner in the storage chamber 310*b* is prevented from being overflowed to the outside.

(Shutter Opening/Closing Mechanism)

Figure 25:
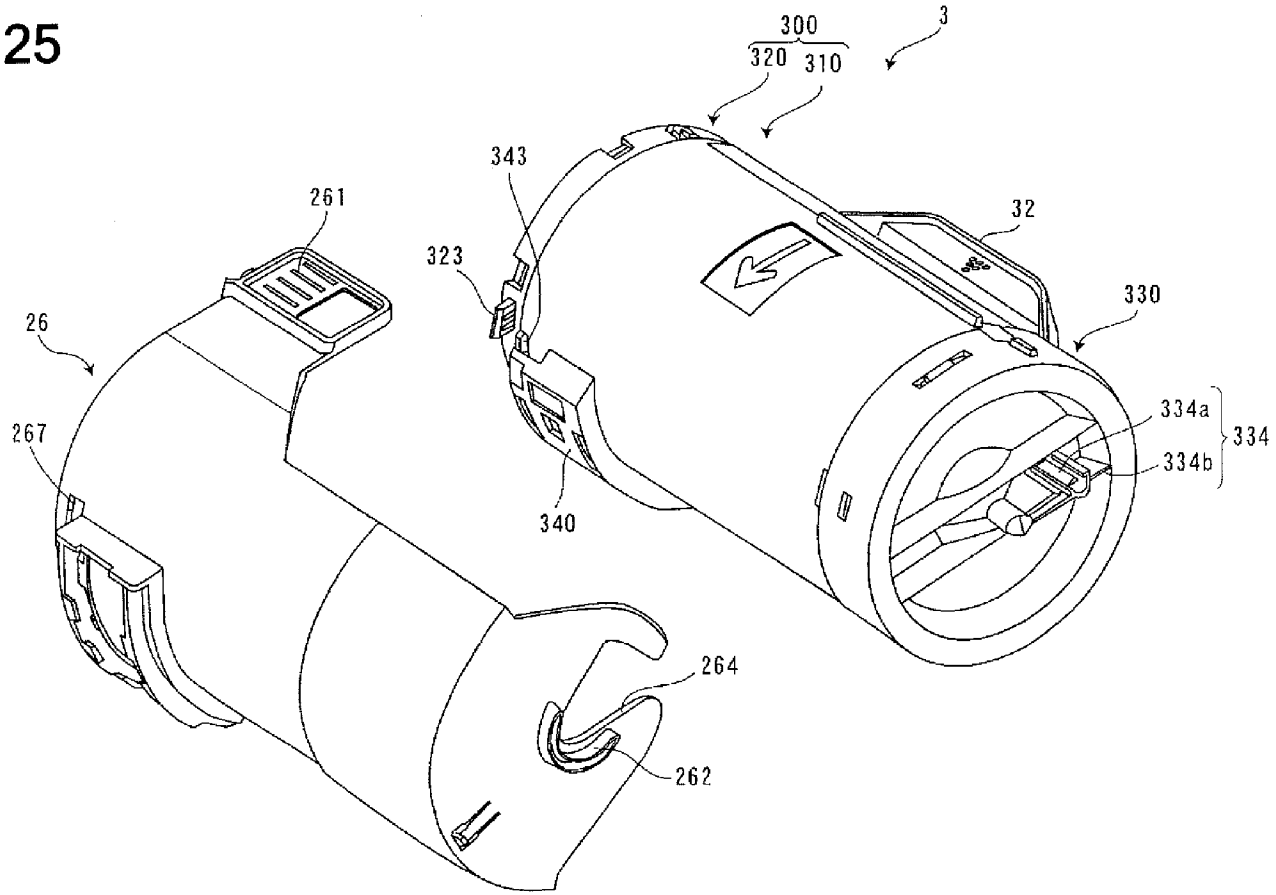
FIG. 25 is a perspective view illustrating the toner cartridge and a fixing member.
Figure 26:
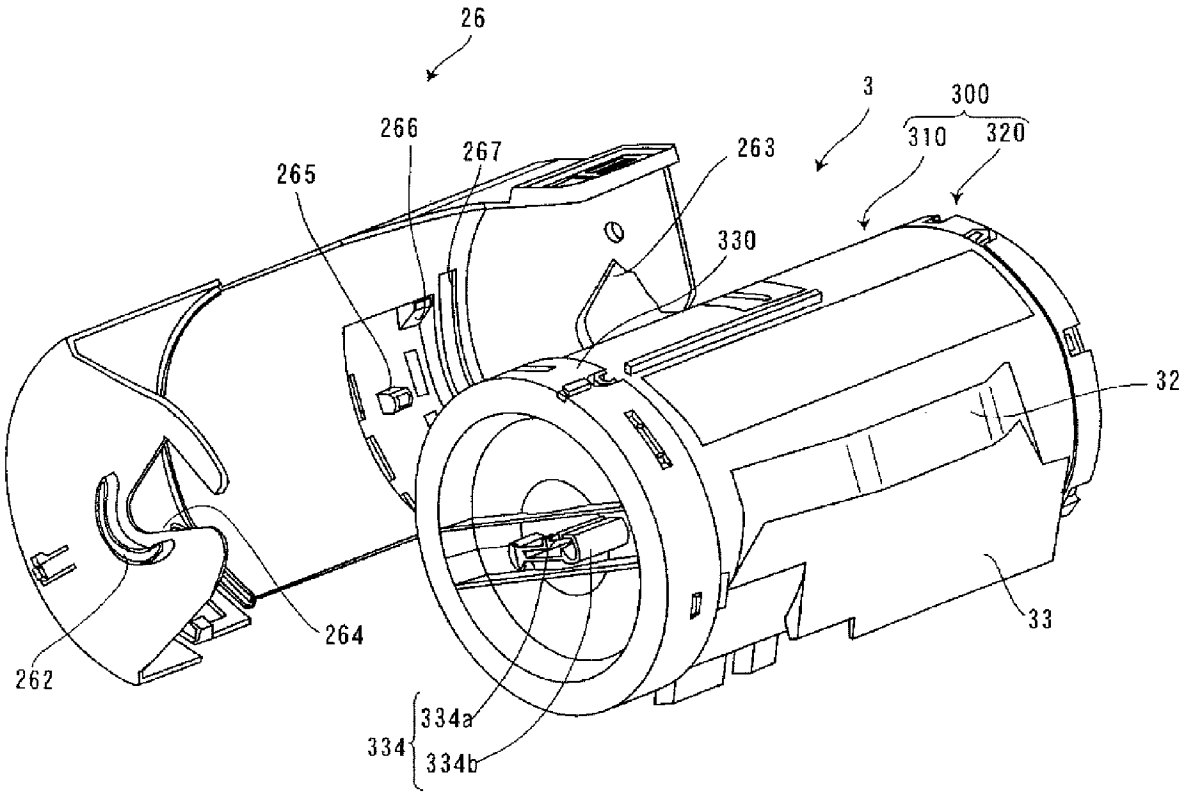
FIG. 26 is a perspective view illustrating the toner cartridge and the fixing member when viewed from a direction different from that of FIG. 25.

FIGS. 25 and 26 are perspective views illustrating the toner cartridge and the fixing member when viewed from directions different from each other.

The fixing member 26 is a member installed in the process cartridge 2 (see FIG. 1) of the apparatus to rotate the knob 261 in a direction of arrow E-F shown in FIG. 1 while a user grips the knob 261.

Here, only the fixing member 26 is removed from the apparatus to be shown together with the toner cartridge 3.

A rib 262 freely rotatably supported by the apparatus, the locker 324 (see, for example, FIG. 7) installed in the first wall 320 of the toner cartridge 3, and cutaway portions 263 and 264 for receiving the locker 334 installed in the second wall 330 are formed on opposite side surfaces of the fixing member 26.

As shown in FIG. 26, a boss 265 and an inclined surface 266 are formed on the inner surface of the fixing member 26, and a slit 267 passing through the inner and outer surfaces of the fixing member 26 is formed in the fixing member 26.

The boss 265 enters into the recess 342 (see FIG. 7) of the shutter 340 when the toner cartridge 3 is mounted to open and close the shutter 340 through rotation of the fixing member 26.

The inclined surface 266 is at a location contacting the movement blocking hook 343 (see FIGS. 7 and 25) when the toner cartridge 3 is mounted, and the movement blocking hook 343 is pushed down by the inclined surface 266 to a location where the shutter 340 can be moved from the closed location toward the opened location.

The boss 323 (see FIGS. 7 and 25) formed in the toner cartridge 3 enters into the slit 267 to determine a rotation range of the fixing member 26.

Figure 27:
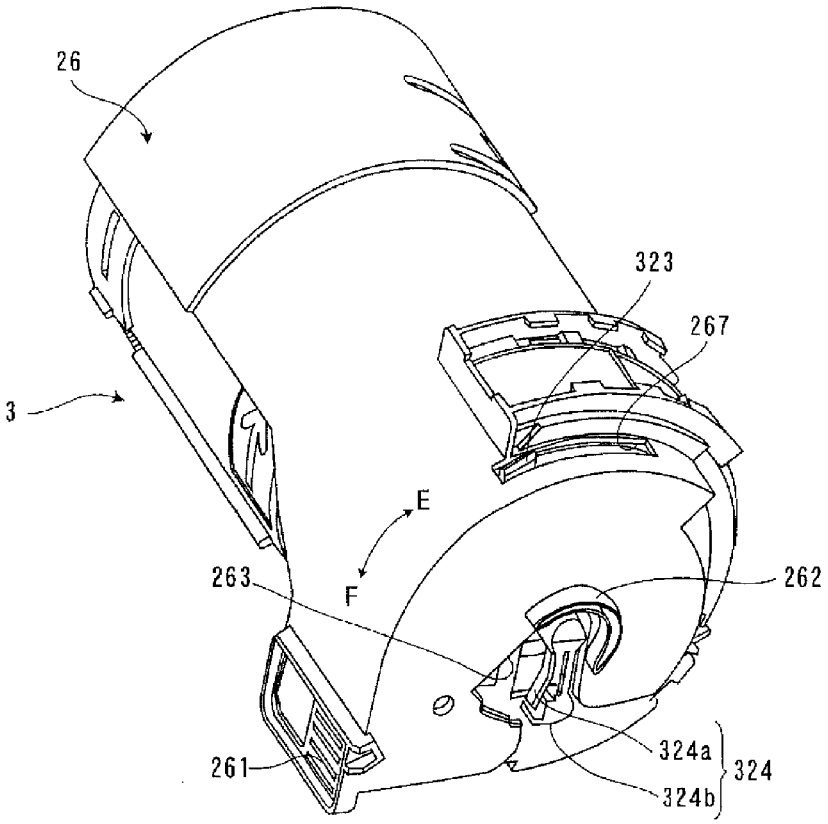
FIG. 27 is a perspective view illustrating a state where the toner cartridge is inserted into the fixing member to be mounted to the apparatus.
Figure 28:
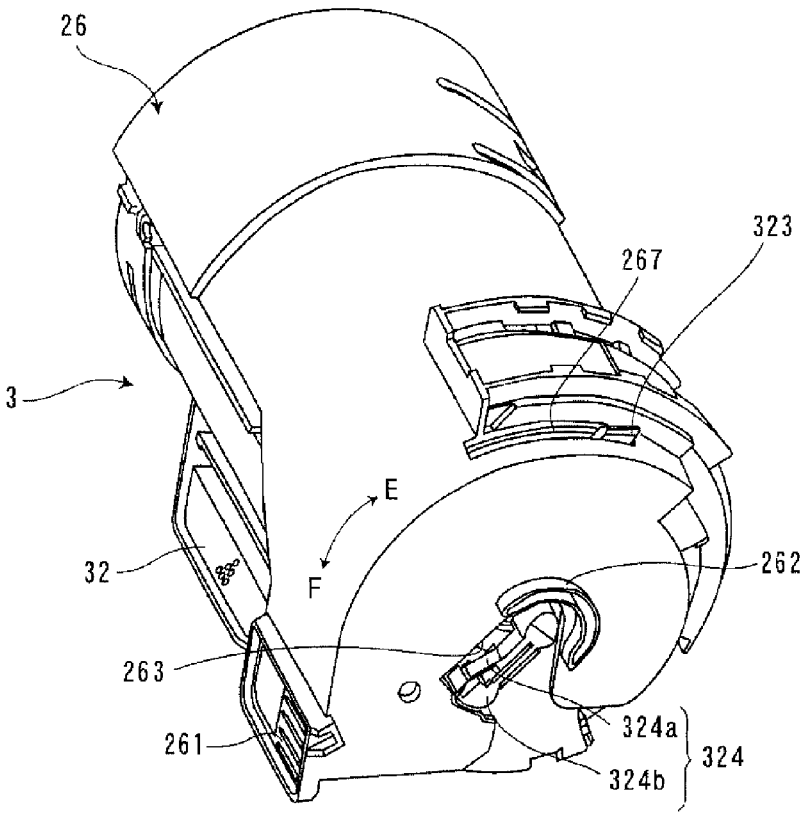
FIG. 28 is a perspective view illustrating a state where the toner cartridge is inserted into the fixing member to be mounted to the apparatus.

FIGS. 27 and 28 are perspective views illustrating a state where the toner cartridge 3 is inserted into the fixing member 26 to be mounted to the apparatus. FIG. 27 is a view before the fixing member 26 is rotated after the toner cartridge 3 is mounted, and FIG. 28 is a view after the fixing member 26 is rotated further.

As shown in FIG. 27, if the toner cartridge 3 is mounted, the boss 323 is inserted into the slit 267. As shown in FIG. 28, if the fixing member 26 is rotated in a direction of arrow F while the knob 261 is gripped, the boss 323 is moved into the slit 267 (a slit 267 side is moved exactly) and collides with a periphery of the slit 267, so that the fixing member 26 cannot be rotated further in the direction of arrow F. Then, the shutter 340 (for example, see FIG. 7) is moving to the opened location.

As shown in FIG. 27, if the toner cartridge 3 is mounted, the locker 324 enters into the cutaway portion 263. As shown in FIG. 25, the locker 334 also enters into the cutaway portion 264. As shown in FIG. 28, if the fixing member 26 is rotated in the direction of arrow F, the second locking portion 324*b* of the locker 324 is pressed by the cutaway portion 263, and is fixed such that the toner cartridge 3 is prevented from being withdrawn from the apparatus. It is the same for the locker 334. The details of the lockers 324 and 334 will be described below.

Now, the shutter opening/closing mechanism will be described again using a cross-section of the shutter portion of the toner cartridge 3.

Figure 29:
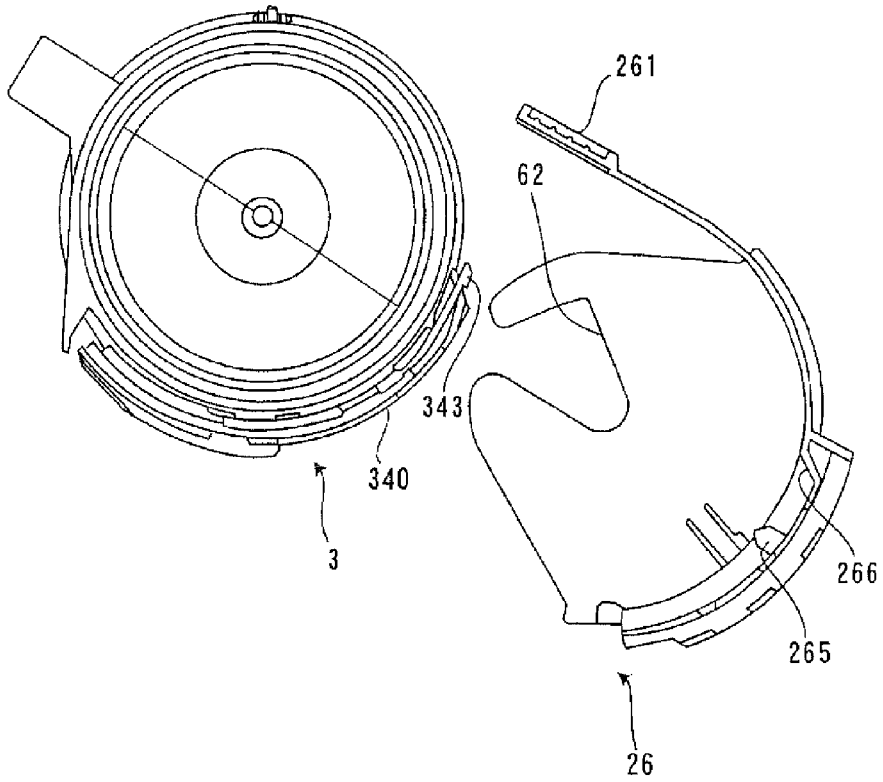
FIG. 29 is a view illustrating the toner cartridge before mounting thereof, and the fixing member for receiving the toner cartridge.

FIG. 29 is a view illustrating the toner cartridge before mounting thereof, and the fixing member receiving the toner cartridge.

FIG. 29 shows the movement blocking hook 343, and the inclined surface 266 pushing down the movement blocking hook 343. FIG. 29 also shows the boss 265 for opening and closing the shutter 340. The movement blocking hook 343 is formed at a front end of the portion extending in a cantilever-shaped shape. The movement blocking hook 343 is raised to a location where the movement blocking hook 343 is hooked by the front end of the shutter 340 in the movement direction thereof to the opened location of the shutter 340. The toner supplying opening 310*a* is closed by the shutter 340.

Figure 30:
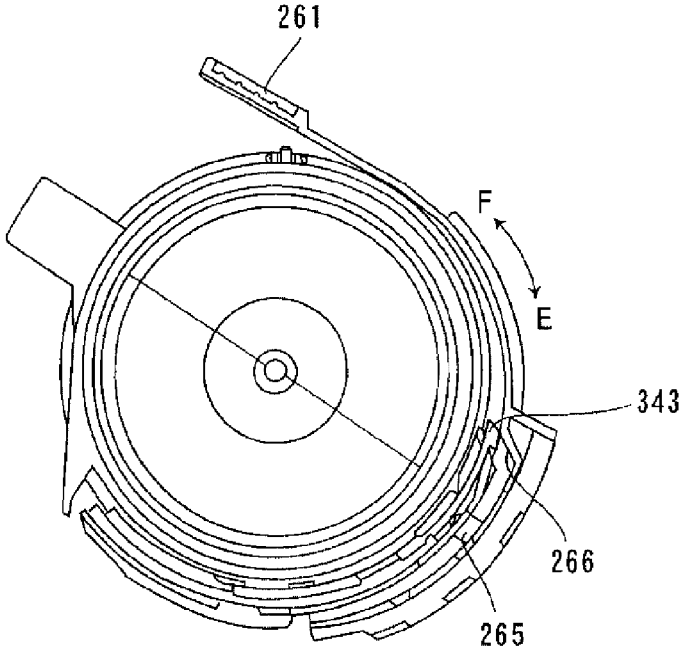
FIG. 30 is a sectional side view illustrating a state before the fixing member is rotated, after the toner cartridge is mounted.
Figure 31:
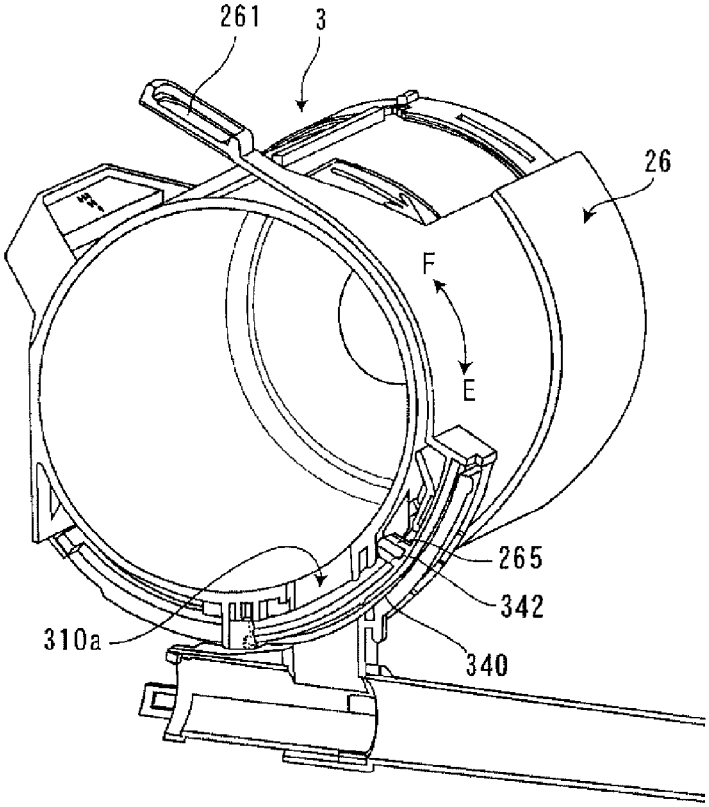
FIG. 31 is a sectional perspective view illustrating the state before the fixing member is rotated, after the toner cartridge is mounted.

FIGS. 30 and 31 are a sectional side view and a sectional perspective view illustrating a state before the fixing member is rotated, after the toner cartridge 3 is mounted. In this case, FIG. 30 is a view illustrating a section of the movement blocking hook 343 and FIG. 31 is a view illustrating a section of the boss 265.

In this step, the movement blocking hook 343 is pressed and pushed down by the inclined surface 266, so that the shutter 340 can be moved. The boss 265 enters into the recess 342 (see FIG. 7) of the shutter 340, and can be rotated in conjunction with the rotation of the fixing member 26. The toner supplying opening 310*a* remains blocked by the shutter 340.

Figure 32:
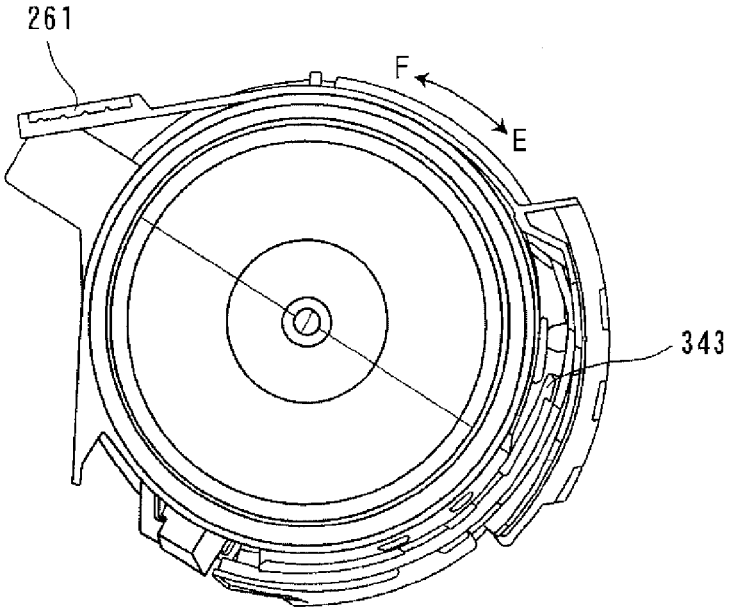
FIG. 32 is a sectional side view illustrating a state where the fixing member is rotated further in the state of FIGS. 30 and 31.
Figure 33:
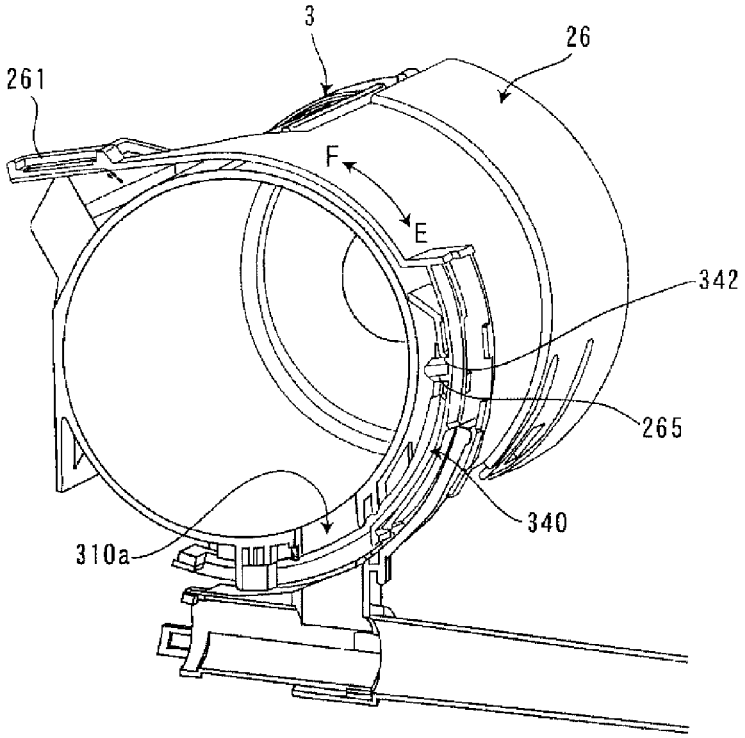
FIG. 33 is a sectional perspective view illustrating the state where the fixing member is rotated further in the state of FIGS. 30 and 31.

FIGS. 32 and 33 are a sectional side view and a sectional perspective view, respectively, illustrating a state where the fixing member 26 is rotated further in the state of FIGS. 30 and 31.

If the fixing member 26 is rotated in the direction of arrow F, the boss 265 having entered into the recess 342 (also, see FIG. 7) moves the shutter 340 to the opened location in the same rotating direction. Then, as shown in FIG. 33, the opening 310*a* is opened, and the toner in the toner cartridge 3 is supplied to the apparatus.

(Lockers)

Next, operations of the lockers installed in the first wall 320 and the second wall (cover) 330 of the toner cartridge 3 will be described.

Figure 34:
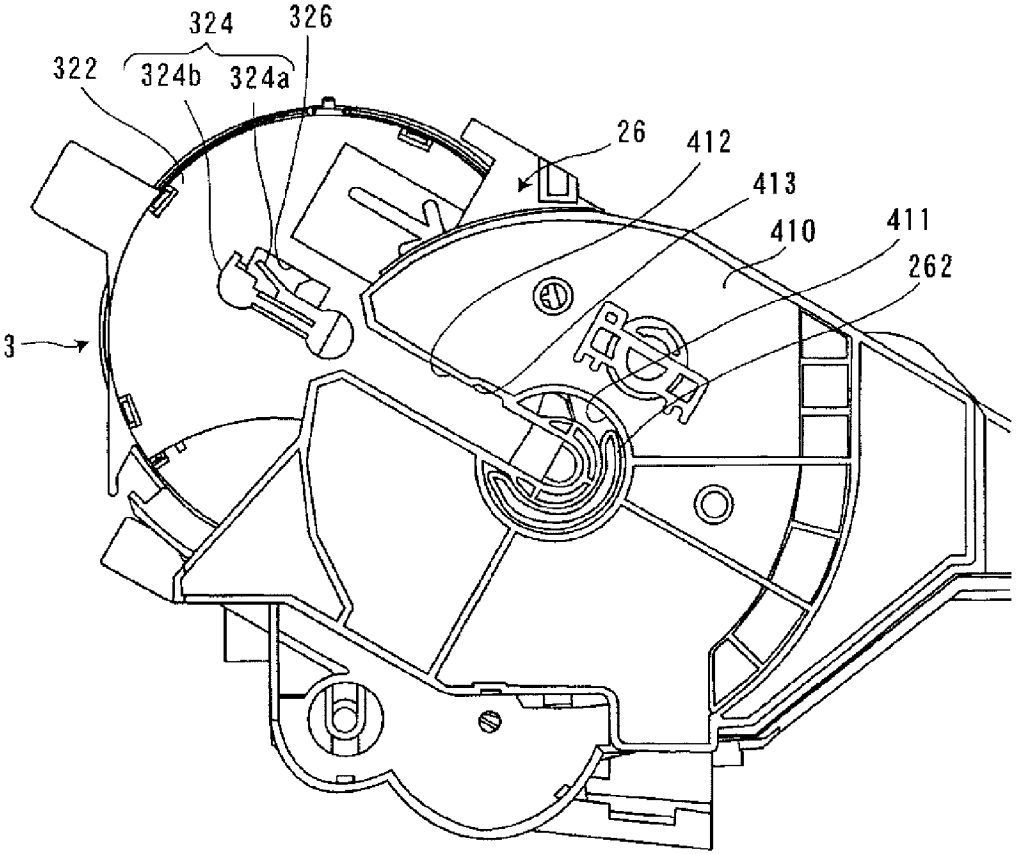
FIG. 34 is a side view illustrating a state where the toner cartridge is mounted, when viewed from the first wall of the toner cartridge.

FIG. 34 is a side view illustrating a state where the toner cartridge 3 is mounted, when viewed from the first wall of the toner cartridge. FIG. 34 shows the toner cartridge 3, the fixing member 26, and a support member 410 constituting the process cartridge 2 (see FIG. 1), for freely rotatably supporting the fixing member 26.

The rib 262 installed on a side surface of the fixing member 26 is installed into an arc-shaped slit 411 installed in the support member 410, and the fixing member 26 is freely rotatably supported by the support member 410. Here, even though the first wall 320 side is shown, the fixing member 26 is freely rotatably supported by the support member 410 in the second wall (cover) 330 side as well.

A long groove 412 extending long to receive the locker 324 is formed in the support member 410, and an end 413 is formed in the groove 412.

As described above, the locker 324 having the first locking portion 324*a* and the second locking portion 324*b* is formed in the cap 322 forming the outer wall surface of the first wall 320 in the first wall 320. For example, as shown in FIG. 7, the locker 324 is formed at a location protruding from the outer surface of the cap 322 toward the outside in the rotation center axis direction. The first locking portion 324*a* constituting the locker 324 has a cantilever-shape extending in a direction perpendicular to a direction following the outer wall surface of the cap 322, that is, the rotation center axis direction. A hole 326 passes through the cap 322. The hole 326 is a hole provided by a need to form the locker 324 having the cantilever-shaped first locking portion 324*a* by molding a resin.

Figure 35:
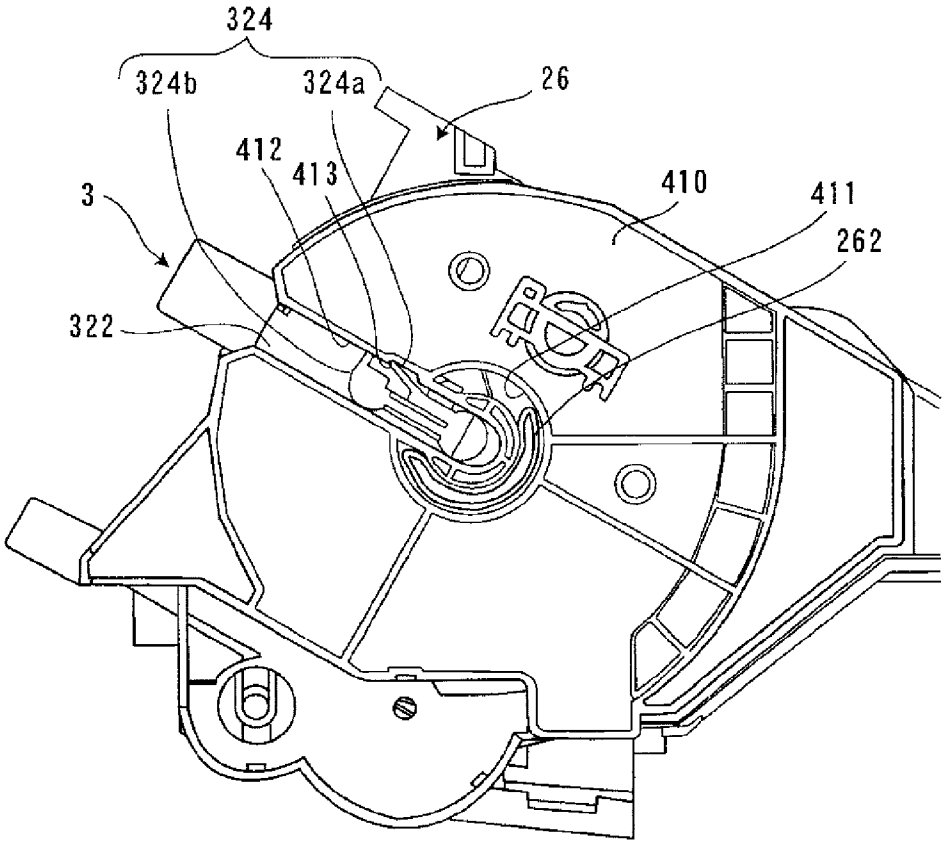
FIG. 35 is a side view illustrating a state before the fixing member is rotated, after the toner cartridge is mounted to the apparatus, when viewed from the first wall of the toner cartridge.

FIG. 35 is a side view illustrating a state before the fixing member is rotated, after the toner cartridge is mounted to the apparatus, when viewed from the first wall of the toner cartridge.

If the toner cartridge is mounted, the locker 324 enters into the groove 412 of the support member 410, and a front end of the first locking portion 324*a* is caught by the end 413 in the groove 412. In this state, if the toner cartridge 3 is pulled and withdrawn strongly to a degree, the first locking portion 324*a* is resiliently deformed to be released from the end 413 so that the toner cartridge 3 can be pulled and withdrawn. However, as long as the toner cartridge 3 is not to be pulled and withdrawn, the first locking portion 324*a* remains caught by the end 413.

As described above, since the gear 321 (see, for example, FIG. 7) for rotating the agitation member 31 (see FIG. 1), the inclined surface 266 (see FIG. 26) pressing the movement blocking hook 343 (see FIG. 7), or the like is disposed in the first wall 320, a repulsive force with a certain magnitude is applied to the toner cartridge 3 if the toner cartridge 3 is mounted to the apparatus. Accordingly, if there is not the first locking portion 324*a*, it is necessary to rotate the fixing member 26 with one hand while the other hand presses the mounted toner cartridge 3.

In the state where the first locking portion 324*a* is caught by the end 413, the movement blocking hook 343 can be pressed by the inclined surface 266 to move the shutter 340, and if the toner cartridge 3 is mounted until a first locking portion 343*a* is caught by the end 413, a hand is released from the toner cartridge 3 and the knob 261 of the fixing member 26 is gripped by the hand, so that the toner cartridge 3 is completely mounted by rotating the fixing member 26.

Figure 36:
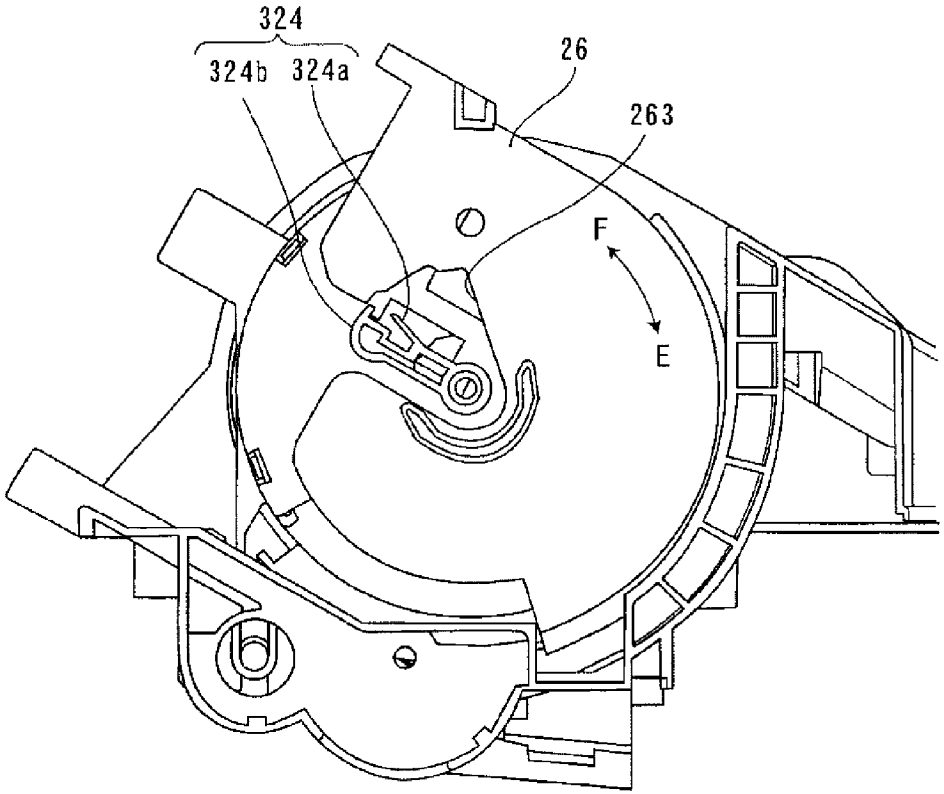
FIG. 36 is view illustrating a state before the fixing member is rotated, after the toner cartridge is mounted, as in FIG. 35, with a side thereof immediately in front of the support member being separated.

FIG. 36 is view illustrating a state before the fixing member is rotated, after the toner cartridge is mounted, as in FIG. 35, with a wall surface thereof immediately in front of the support member 410 being separated. FIG. 36 is a view showing the fixing member 26 inside the support member 410.

In this state, even through the locker 324 is received by the cutaway portion 263 of the fixing member 26, the locker 324 does not interfere with the cutaway portion 263. As shown in FIG. 35, in this state, the first locking portion 324*a* of the locker 324 remains caught by the end 413 of the support member 410 located outside the fixing member 26.

Figure 37:
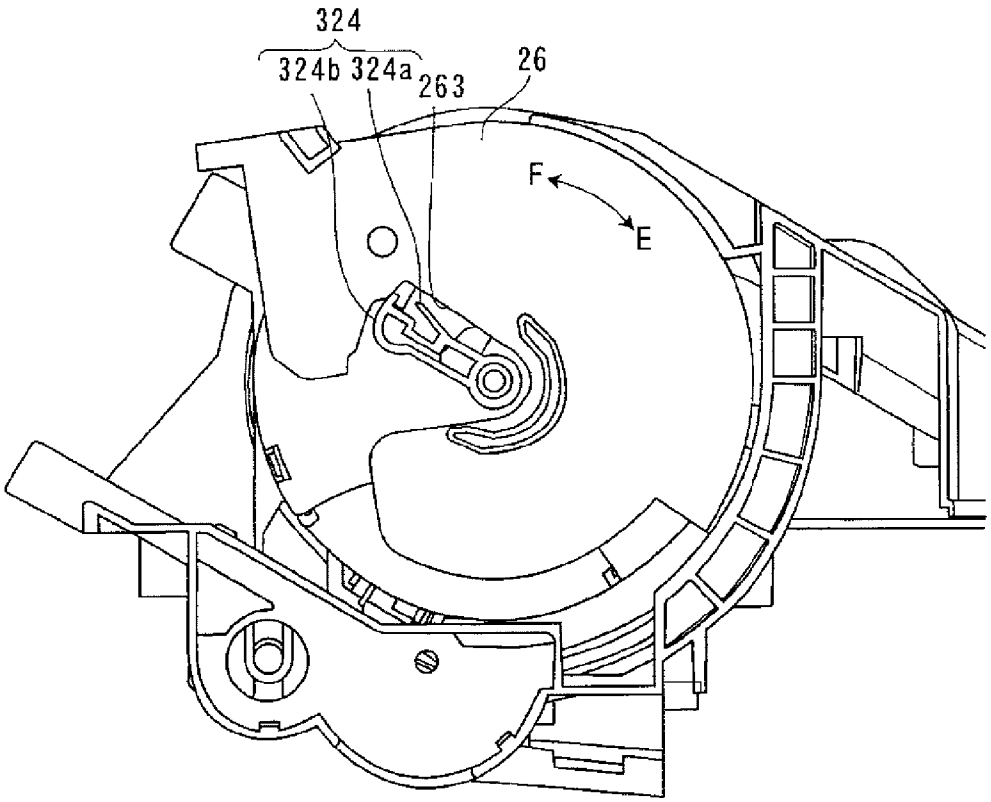
FIG. 37 is a view illustrating a state where the fixing member is rotated in a direction of arrow F from the state of FIG. 36.

FIG. 37 is a view illustrating a state where the fixing member 26 is rotated in the direction of arrow F from the state of FIG. 36. As in FIG. 36, FIG. 37 shows a state where the support member 410 is removed.

If the fixing member 26 is rotated in the direction of arrow F, the shutter is moved to the opened location as described above, and as shown in FIG. 37, the second locking portion 324*b* is pressed in the mounting direction by the cutaway portion 263 of the fixing member 26, preventing the toner cartridge 3 from being withdrawn with certainty.

Figure 38:
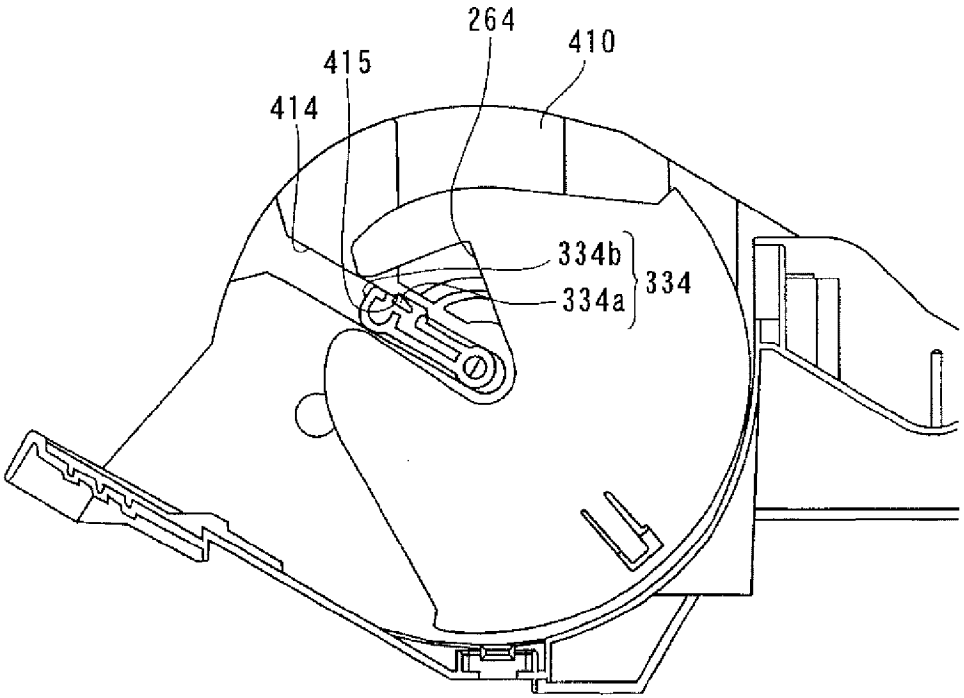
FIG. 38 is a view illustrating a locker of the second wall (cover) of the toner cartridge.
Figure 39:
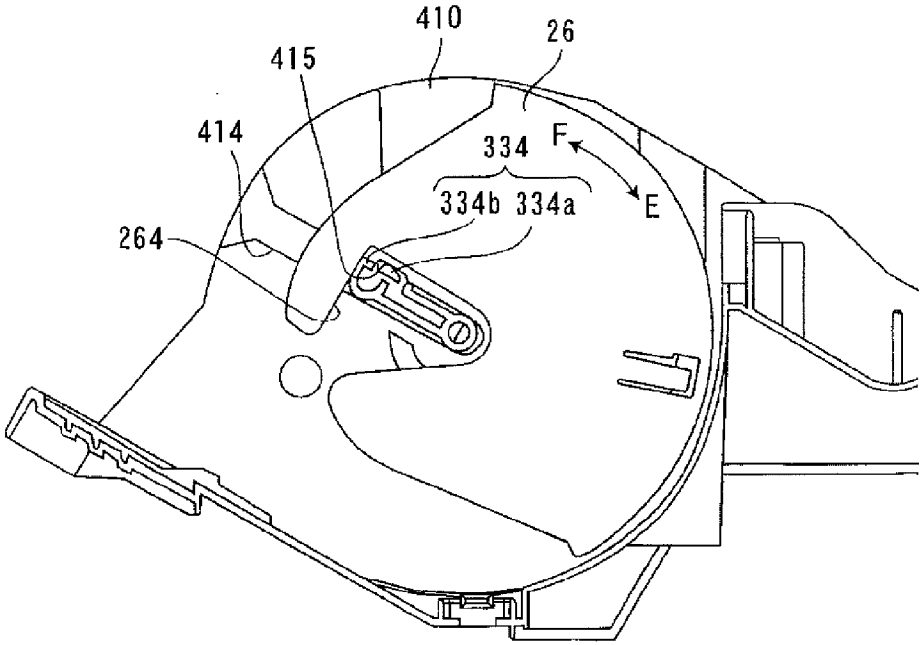
FIG. 39 is a view illustrating a state where the shutter is opened by rotating the fixing member from the state of FIG. 38.

FIG. 38 is a view illustrating a locker of the second wall (cover) of the toner cartridge. FIG. 38 and FIG. 39 which will be described below are views of the second wall (cover) side when viewed from the inner side of the toner cartridge and show a state where the toner cartridge itself is removed except for the locker.

The locker 334 having the first locking portion 334*a* and the second locking portion 334*b* is installed in the second wall (cover) of the toner cartridge 3. The locker 334 has a shape protruding from the second wall (cover) 330 toward the outside in the rotation center axis direction (see FIGS. 25 and 26). Here, unlike the first locking portion 324*a* (see, for example, FIG. 27) of the first wall 320, the first locking portion 334*a* constituting the locker 334 has a cantilever-shape extending to the outside in the rotation center axis direction. This is because as the toner needs to be sealed, the hole 326 (see FIG. 34) for molding cannot be formed in the second wall (cover) 330 like the cap 322 constituting the first wall 320.

The first locking portion 334*a* of the second wall (cover) 330 has a short length between the fixing end and the free end thereof as compared with the first locking portion 324*a* of the first wall 320. This is because when the toner cartridge 3 is mounted to the apparatus, a repulsive force on the second wall 330 is smaller than that on the first wall 320 so that the repulsive forces can be balanced by making a length of the first locking portion 334*a* shorter. That is, by catching the side having the smaller repulsive force weak, the toner cartridge 3 can be easily pulled and withdrawn in parallel to the rotation center axis when the toner cartridge 3 is pulled and withdrawn.

A groove 414 is formed in the support member 410 on the second wall (cover) 330 side, and an end 415 catching the first locking portion 334*a* is formed in the support member 410. If the toner cartridge 3 is mounted, the first locking portion 334*a* is caught by the end 415. Here, the first locking portion 334*a* of the second wall (cover) 330 is caught by the end 415 with a locking force weaker than a magnitude of the locking force produced as the first locking portion 334*a* is caught by the end 413 of the first locking portion 324*a* of the first wall 320. As described above, this is to allow the first locking portions 324*a* and 334*a* to be released from the ends 413 and 415 with the same-leveled left and right forces when the toner cartridge 3 is pulled and withdrawn.

FIG. 39 is a view illustrating a state where the shutter is opened by rotating the fixing member from the state of FIG. 38.

If, the fixing member 26 is rotated in the direction of arrow F, the second locking portion 334*b* is pressed by the cutaway portion 264 of the fixing member 26, preventing the toner cartridge 3 from being withdrawn with certainty.

The foregoing description of the exemplary embodiment of the present invention has been provided for the purpose of illustration and description. It is not intended to be exhaustive or to limit the invention to the precise forms disclosed. Obviously, many modifications and various will be apparent to practitioners skilled in the art. The embodiments were chosen and described in order to best explain the principles of the invention and its practical application, thereby enabling other skilled in the art to understand the invention for various embodiments and with the various modifications as are suited to the particular use contemplated. It is intended that the scope of the invention be defined by the following claims and their equivalents.

What is claimed is:

1. A powder container comprising:

a container body that includes a body and a wall portion that caps one longitudinal end of the body, powder is filled in the container body in a state where the other end of the body is opened;

an agitation member that agitates the powder accommodated within the container body, the agitation member being accommodated in the container body and receiving a driving force from outside to be rotated and to agitate the powder; and a cover that covers the other end of the body, wherein the agitation member includes:

a shaft member installed in the longitudinal direction of the body, receiving the driving force from the outside to be rotated, and including:

a driving force receiving part formed at a wall side end of the shaft member to receive the driving force from the outside; and a supported part formed at a cover side end of the shaft member to be rotatably supported by the cover;

a flexible sheet type member that agitates the powder accommodated within the container body, the flexible sheet being supported by the shaft member and extending in the diameter direction toward the inner peripheral surface of the body; and a plurality of arm members that extend in a plurality of directions from the shaft member toward the inner peripheral surface of the body with respect to the rotation direction of the shaft member, respectively, which are different from the direction where the sheet type member extends toward the inner peripheral surface of the body with respect to the rotation direction of the shaft member, the plurality of arm members being rotated integrally with the shaft member, the cover includes a supporting part that rotatably supports the supported part of the shaft member, and the cover is a separate member from the container body.

2. The powder container according to claim 1, wherein the plurality of arm members include:

a plurality of first arm members installed on the shaft member closer to the wall portion than a center portion of the shaft member in a longitudinal direction of the shaft member and rotated integrally with the shaft member; and a plurality of second arm members installed on the shaft member closer to the cover than the center portion of the shaft member in the longitudinal direction of the shaft member and rotated integrally with the shaft member.

3. The powder container according to claim 2, wherein at least one arm member among the first arm members and the second arm members includes an inclined surface that generates a component force pressing the powder in a direction to the center portion when the shaft member rotates.

4. The powder container according to claim 2, wherein the powder container is mountable to an apparatus that receives and uses the powder accommodated within the powder container in a posture where the longitudinal direction is the transverse direction of the apparatus, and includes an opening below the shaft member in the posture where the powder container is mounted to the apparatus, the powder within the powder container being supplied to the apparatus through the opening, and at least one arm member among the first arm members and the second arm members passes through a location that faces the opening when the shaft member rotates.

5. An image forming apparatus which is mounted with a powder container according to claim 1 to form an image using the powder accommodated within the powder container.

6. The powder container according to claim 1, wherein the cover is a removable member and covers the other end of the body.

7. A powder container comprising:

a container body that includes a body and a wall portion that caps one longitudinal end of the body, powder is filled in the container body in a state where the other end of the body is opened;

an agitation member that agitates the powder accommodated within the container body, the agitation member being accommodated in the container body and receiving a driving force from outside to be rotated and to agitate the powder; and a cover that covers the other end of the body, wherein the agitation member includes:

a shaft member installed in the longitudinal direction of the body, receiving the driving force from the outside to be rotated, and including:

a driving force receiving part formed at a wall side end of the shaft member to receive the driving force from the outside; and a supported part formed at a cover side end of the shaft member to be rotatably supported by the cover;

a flexible sheet type member that agitates the powder accommodated within the container body, the flexible sheet being supported by the shaft member and extending in the diameter direction toward the inner peripheral surface of the body; and a plurality of arm members that extend in a plurality of directions from the shaft member toward the inner peripheral surface of the body with respect to the rotation direction of the shaft member, respectively, which are different from the direction where the sheet type member extends toward the inner peripheral surface of the body with respect to the rotation direction of the shaft member, the plurality of arm members being rotated integrally with the shaft member, and the cover includes a supporting part which rotatably supports the supported part of the shaft member and an inclined guide surface which guides the supported part of the shaft member to the supporting part of the cover when the cover is attached to the container body in assembling the powder container.

* * * * *